US007485199B2

(12) United States Patent
Sugahara

(10) Patent No.: US 7,485,199 B2
(45) Date of Patent: Feb. 3, 2009

(54) NI BASED ALLOY WITH EXCELLENT CORROSION RESISTANCE TO SUPERCRITICAL WATER ENVIRONMENTS CONTAINING INORGANIC ACIDS

(75) Inventor: Katsuo Sugahara, Kitamoto (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 10/501,100

(22) PCT Filed: Jan. 8, 2003

(86) PCT No.: PCT/JP03/00075

§ 371 (c)(1),
(2), (4) Date: Jul. 6, 2004

(87) PCT Pub. No.: WO03/057933

PCT Pub. Date: Jul. 17, 2003

(65) Prior Publication Data

US 2005/0158203 A1 Jul. 21, 2005

(30) Foreign Application Priority Data

| | | | |
|---|---|---|---|
| Jan. 8, 2002 | (JP) | ..... | 2002-001217 |
| Jan. 8, 2002 | (JP) | ..... | 2002-001218 |
| Aug. 9, 2002 | (JP) | ..... | 2002-232838 |
| Aug. 9, 2002 | (JP) | ..... | 2002-232847 |

(51) Int. Cl.
*C22C 19/05* (2006.01)

(52) U.S. Cl. ..... 148/427; 420/443

(58) Field of Classification Search ..... 148/427
See application file for complete search history.

(56) References Cited

U.S. PATENT DOCUMENTS

| | | | | |
|---|---|---|---|---|
| 3,619,182 | A * | 11/1971 | Bieber et al. | 420/448 |
| 3,619,183 | A * | 11/1971 | Olson et al. | 420/448 |
| 3,918,964 | A * | 11/1975 | Baldwin et al. | 420/451 |
| 3,984,239 | A * | 10/1976 | Petersen | 420/446 |
| 5,958,332 | A * | 9/1999 | Hoeg | 420/442 |
| 6,106,643 | A * | 8/2000 | Suarez et al. | 148/668 |
| 6,761,854 | B1 * | 7/2004 | Smith et al. | 420/443 |
| 2001/0018139 | A1 | 8/2001 | Aoyama et al. | |
| 2002/0172849 | A1 | 11/2002 | Fan et al. | |
| 2003/0068523 | A1 | 4/2003 | Kaneta et al. | |
| 2003/0134174 | A1 | 7/2003 | Akikusa et al. | |

FOREIGN PATENT DOCUMENTS

| | | | |
|---|---|---|---|
| EP | 0303957 | | 2/1989 |
| JP | 6-128671 | * | 5/1994 |
| JP | 06-128671 | | 5/1994 |
| JP | 6-128671 A | | 5/1994 |
| JP | 07-11366 | | 1/1995 |
| JP | 07090440 | | 4/1995 |
| JP | 8-103867 | * | 4/1996 |
| JP | 09-256087 | | 9/1997 |
| JP | 9-256087 | * | 9/1997 |
| JP | 09256087 | | 9/1997 |
| JP | 2003173792 | | 6/2003 |
| JP | 2005317479 | | 11/2005 |
| WO | 97/43457 | | 11/1997 |
| WO | 03057933 | | 7/2003 |

OTHER PUBLICATIONS

Kritzer, Peter; Dinjus, Eckhard "An assessment of supercritical water oxidation (SCWO) Existing problems, possible solutions and new reactor concepts" Chemical Engineering Journal, (83) 2001, pp. 207-214.*

Patent Abstracts of Japan for JP09-256087 published on Sep. 30, 1997.

Patent Abstracts of Japan for JP07-11366 published on Jan. 13, 1995.

Patent Abstracts of Japan for JP06-128671 published on May 10, 1994.

Patent Abstracts of Japan for JP6-128671 published May 10, 1994.

* cited by examiner

*Primary Examiner*—John P. Sheehan
*Assistant Examiner*—Jessee R. Roe
(74) *Attorney, Agent, or Firm*—Darby & Darby P.C.

(57) ABSTRACT

A Ni based alloy with a composition including Cr: from more than 43% to 50% or less, Mo: 0.1% to 2%, Mg: 0.001% to 0.05%, N: 0.001% to 0.04%, Mn: 0.05% to 0.5%, and where necessary also including either one, or both, of Fe: 0.05% to 1.0% and Si: 0.01% to 0.1%, and the remainder as Ni and unavoidable impurities, in which the quantity of C amongst the unavoidable impurities is restricted to 0.05% or less. It has excellent corrosion resistance relative to supercritical water environments containing inorganic acids. Also provided is a member for a supercritical water process reaction apparatus comprises the Ni based alloy.

3 Claims, No Drawings

NI BASED ALLOY WITH EXCELLENT CORROSION RESISTANCE TO SUPERCRITICAL WATER ENVIRONMENTS CONTAINING INORGANIC ACIDS

CROSS-REFERENCE TO PRIOR APPLICATION

This is a U.S. national phase application under 35 U.S.C. § 371 of International Patent Application No. PCT/JP03/00075 filed Jan. 8, 2003, and claims the benefit of Japanese Patent Application Nos. 2002-1217 filed Jan. 8, 2002; 2002-1218 filed Jan. 8, 2002; 2002-232838 filed Aug. 9, 2002 and 2002-232847 filed Aug. 9, 2002 which are incorporated by reference herein. The International Application was published in Japanese on Jul. 17, 2003 as WO 03/057933 A1 under PCT Article 21(2).

TECHNICAL FIELD

The present invention relates to a Ni based alloy with excellent corrosion resistance to (i) supercritical water containing inorganic acids such as hydrochloric acid, sulfuric acid, phosphoric acid and hydrofluoric acid generated by the decomposition and oxidation of organic toxic materials such as VX gas, GB (sarin) gas and mustard gas used in chemical weapons and the like, or (ii) supercritical water containing inorganic acids such as hydrochloric acid generated by the decomposition and oxidation of organic toxic materials such as PCBs and dioxin, which represent industrial waste products for which disposal is difficult. The invention also relates to a member for a supercritical water process reaction apparatus formed from such a Ni based alloy.

Furthermore, the present invention also relates to a Ni based alloy that displays excellent resistance to stress corrosion cracking in supercritical water environments containing inorganic acids, and a member for a supercritical water process reaction apparatus formed from such a Ni based alloy, and more particularly to a Ni based alloy that displays excellent resistance to stress corrosion cracking in (i) supercritical water environments containing non-chlorine based inorganic acids such as sulfuric acid, phosphoric acid and hydrofluoric acid generated by the decomposition and oxidation of organic toxic materials such as VX gas, GB (sarin) gas and mustard gas used in chemical weapons and the like, or (ii) supercritical water environments containing inorganic acids that comprise chlorine such as hydrochloric acid generated by the decomposition and oxidation of organic toxic materials such as PCBs and dioxin, which represent industrial waste products for which disposal is difficult, as well as a member for a supercritical water process reaction apparatus formed from such a Ni based alloy.

BACKGROUND ART

Water at a temperature/pressure exceeding the critical point (specifically, water at a temperature/pressure exceeding 374° C./22.1 MPa) is known as supercritical water, and is capable of dissolving a huge variety of materials. Water in this supercritical state exists in a non-condensable, high density gaseous state, and is capable of completely dissolving non-polar or very slightly polar materials (such as hydrocarbon compounds or gases) which display only very limited solubility in water at room temperature, and it is reported that by also adding oxygen to the supercritical water, these dissolved materials can be oxidized and decomposed.

The organic toxic materials used in chemical weapons and the like are no exception, and can be dissolved completely in supercritical water, and by also incorporating dissolved oxygen in the supercritical water and reacting the organic toxic materials contained within the chemical weapons or the like in the supercritical water, oxidation and decomposition into non-toxic materials such as carbon dioxide, water, sulfuric acid and phosphoric acid can be achieved. For example, VX gas can be oxidized and decomposed into sulfuric acid and phosphoric acid, and GB gas can be oxidized and decomposed into hydrofluoric acid and phosphoric acid. Accordingly, in recent years in the U.S.A., tests have been conducted on using supercritical water in the disposal of chemical weapons that contain VX gas, GB (sarin) gas, mustard gas or the like, by decomposing and oxidizing, and thus detoxifying, the organic toxic materials of VX gas, GB (sarin) gas and mustard gas, which are difficult to break down under normal conditions. Once this method for decomposing, oxidizing and detoxifying the organic toxic materials of VX gas, GB (sarin) gas and mustard gas and the like using supercritical water becomes established, it will provide a much more environmentally friendly process than the conventional incineration treatment methods, as the supercritical water and oxidizing agent have no adverse effects on the environmental. Furthermore, because supercritical water is highly reactive, organic toxic materials such as VX gas, GB (sarin) gas and mustard gas can be decomposed, oxidized and detoxified within a short period of time. In addition, the decomposition treatment can be carried out within a closed system, meaning there is no danger of environmental pollution caused by emissions or discharge.

Furthermore, organic toxic materials such as PCBs and dioxin, which represent industrial waste products for which disposal is difficult, are also no exception, and can be dissolved completely in supercritical water. By adding oxygen and reacting the organic toxic materials within the supercritical water, oxidation and decomposition into non-toxic materials such as carbon dioxide, water, and hydrochloric acid can be achieved. This process can be carried out within a closed system, meaning that compared with conventional incineration treatment methods, there is no danger of environmental pollution caused by emissions or discharge.

When supercritical water is used as the reaction solvent for decomposing and oxidizing organic toxic materials such as VX gas, GB (sarin) gas and mustard gas, the oxidation and decomposition in high temperature, high pressure (400° C. to 650° C., 22.1 MPa to 80 MPa) supercritical water generates a mixture of inorganic acids such as sulfuric acid and phosphoric acid with a high concentration of oxygen. As a result, in order to enable supercritical water to be used as the reaction solvent for decomposing, oxidizing, and detoxifying organic toxic materials such as VX gas, GB (sarin) gas and mustard gas, the process reaction apparatus in the system used for detoxifying these organic toxic materials, and in particular the material used for producing the process reaction vessel, must display good corrosion resistance relative to this type of supercritical water environment containing inorganic acids.

Furthermore, when supercritical water is used as the reaction solvent for decomposing and oxidizing organic toxic materials such as PCBs and dioxin, the oxidation and decomposition in high temperature, high pressure (400° C. to 650° C., 22.1 MPa to 80 MPa) supercritical water generates a mixture of inorganic acids containing chlorine such as hydrochloric acid together with a high concentration of oxygen. As a result, in order to enable supercritical water to be used as the reaction solvent for decomposing, oxidizing, and detoxifying organic toxic materials such as PCBs and dioxin, the material used for producing the process reaction vessel in the system used for detoxifying these organic toxic materials must display good corrosion resistance relative to this type of supercritical water environment containing inorganic acids.

Consequently, Ni based corrosion resistant alloys, which are widely known as being highly resistant to corrosion, have been proposed as one possibility for a metal material that could be used for the process reaction apparatus used with supercritical water. Specific examples of such Ni based corrosion resistant alloys include Inconel (a registered trademark) 625 (as prescribed in ASTM UNS N06625, with a composition, expressed as weight percentages, that comprises, for example, Cr: 21.0%, Mo: 8.4%, Nb+Ta: 3.6%, Fe: 3.8%, Co: 0.6%, Ti: 0.2%, and Mn: 0.2%, with the remainder being Ni and unavoidable impurities), and Hastelloy (a registered trademark) C-276 (as prescribed in ASTM UNS N10276, with a composition that comprises, for example, Cr: 15.5%, Mo: 16.1%, W: 3.7%, Fe: 5.7%, Co: 0.5%, and Mn: 0.5%, with the remainder being Ni and unavoidable impurities). Recent reports have stated that Ni based alloys with even higher Cr contents display even better corrosion resistance relative to supercritical water containing inorganic acids. As a result, high Cr content Ni alloys such as MC alloy (with a composition comprising Cr: 44.1%, Mo: 1.0%, Mn: 0.2%, and Fe: 0.1%, with the remainder being Ni and unavoidable impurities) and Hastelloy G-30 (as prescribed in ASTM UNS N06030, with a composition that comprises, for example, Cr: 28.7%, Mo: 5.0%, Mn: 1.1%, Fe: 14.6%, Cu: 1.8%, W: 2.6%, and Co: 1.87%, with the remainder being Ni and unavoidable impurities) are now attracting considerable attention as potential materials for reaction apparatus.

However, amongst conventional Ni based alloys, Inconel 625 and Hastelloy C-276 do not provide adequate corrosion resistance to supercritical water containing acids such as sulfuric acid, phosphoric acid and hydrofluoric acid, and consequently if either of these materials is employed in a process reaction apparatus in a system used for detoxifying organic toxic materials, particularly if employed as the material for producing the process reaction vessel, then long term operation of the system is impossible. MC alloy on the other hand displays good initial corrosion resistance to supercritical water containing acids such as sulfuric acid, phosphoric acid and hydrofluoric acid. However, because the phase stability of the alloy is not entirely satisfactory, phase transformation tends to occur at the operating temperature, leading to a deterioration in the corrosion resistance. Consequently, if MC alloy is used in a reaction apparatus, then long term operation of the system is impossible.

Furthermore Inconel 625 and Hastelloy C-276 do not provide adequate corrosion resistance, with pitting occurring at the contact surfaces between the alloy and the supercritical water containing hydrochloric acid. As a result, if either of these materials is employed as the material for producing the process reaction vessel in a system used for detoxifying these types of organic toxic materials, then long term operation of the system is impossible. MC alloy on the other hand displays good initial corrosion resistance to supercritical water containing hydrochloric acid. However, because the phase stability of the alloy is not entirely satisfactory, phase transformation tends to occur at the operating temperature, leading to a deterioration in the corrosion resistance. Consequently, if MC alloy is used in a reaction apparatus, then long term operation of the system is impossible.

In addition, when a reaction vessel or piping is produced using Inconel (a registered trademark) 625, Hastelloy (a registered trademark) C-276 or Hastelloy (a registered trademark) G-30, then following manufacturing into a sheet or a pipe to make the process material, this process material must be subjected to further manufacturing process such as rolling or bending to complete the production of the reaction vessel or piping for the process reaction apparatus. Because a reaction vessel or piping produced in this manner is prepared by manufacturing process, internal stress or internal distortions remain within the product. Amongst conventional Ni based corrosion resistant alloys, it is known that Inconel 625 and Hastelloy C-276 develop stress corrosion cracking in contact with supercritical water containing non-chlorine based inorganic acids such as sulfuric acid, phosphoric acid and hydrofluoric acid. Consequently, if Inconel 625 or Hastelloy C-276 is used as the material for producing the reaction vessel or piping within a system for detoxifying organic toxic materials, then long term operation of the system is impossible. Hastelloy (a registered trademark) G-30 on the other hand displays good initial resistance to stress corrosion cracking when exposed to supercritical water containing acids such as sulfuric acid, phosphoric acid and hydrofluoric acid. However, because the phase stability of the alloy is not entirely satisfactory, phase transformation tends to progress gradually at the operating temperature (400° C. to 650° C.). If a stress field such as that generated by a high temperature, high pressure supercritical water environment is generated once this phase transformation has already progressed significantly, then stress corrosion cracking can occur. Consequently, Hastelloy G-30 is not an ideal material for producing a process reaction apparatus capable of long term operation.

Similarly, if conventional Ni based corrosion resistant alloys such as Inconel 625 and Hastelloy C-276 with residual internal stress or internal distortion are brought into contact with supercritical water containing hydrochloric acid or the like, then stress corrosion cracking occurs. Consequently, if either of these alloys is used for producing the reaction vessel or piping in a process reaction apparatus for detoxifying organic toxic materials, then long term operation of the system is impossible. Hastelloy (a registered trademark) G-30 on the other hand displays no stress corrosion cracking during initial operations with supercritical water containing hydrochloric acid. However, because the phase stability of the alloy is not entirely satisfactory, phase transformation tends to progress gradually at the operating temperature (400° C. to 650° C.). If a stress field such as that generated by a high temperature, high pressure supercritical water environment is generated once this phase transformation has already progressed significantly, then stress corrosion cracking can occur. Consequently, Hastelloy (a registered trademark) G-30 is not an ideal material for producing a process reaction apparatus capable of long term operation.

DISCLOSURE OF INVENTION

The inventors of the present invention conducted intensive research aimed at producing a Ni based alloy that displays satisfactory corrosion resistance to the types of supercritical water environments containing inorganic acids described above, and also displays excellent phase stability at 400 to 650° C., which would enable operations to be continued for longer periods. As a result of this research, they discovered that a Ni based alloy comprising Cr: from more than 43% to 50% or less (all % values refer to % by weight values), Mo: 0.1 to 2%, Mg: 0.001 to 0.05%, N: 0.001 to 0.04%, Mn: 0.05 to 0.5%, where necessary also comprising either one, or both, of Fe: 0.05 to 1.0% and Si: 0.01 to 0.1%, and the remainder as Ni and unavoidable impurities, wherein the quantity of C amongst the unavoidable impurities is restricted to 0.05% or less, displays excellent corrosion resistance relative to supercritical water environments containing inorganic acids, and also displays excellent phase stability. Moreover, they also discovered that if this Ni based alloy is used as the material for producing a process reaction apparatus in a system for detoxifying organic toxic materials, then extended operation of the system becomes possible.

One aspect A of the present invention is based on these findings, and provides:

(A1) a Ni based alloy with excellent corrosion resistance relative to supercritical water environments containing inorganic acids, comprising Cr: from more than 43% to 50% or less, Mo: 0.1 to 2%, Mg: 0.001 to 0.05%, N: 0.001 to 0.04%, Mn: 0.05 to 0.5%, and the remainder as Ni and unavoidable impurities, wherein the quantity of C amongst the unavoidable impurities is restricted to 0.05% or less, (A2) a Ni based alloy with excellent corrosion resistance relative to supercritical water environments containing inorganic acids, comprising Cr: from more than 43% to 50% or less, Mo: 0.1 to 2%, Mg: 0.001 to 0.05%, N: 0.001 to 0.04%, Mn: 0.05 to 0.5%, further comprising either one, or both, of Fe: 0.05 to 1.0% and Si: 0.01 to 0.1%, and the remainder as Ni and unavoidable impurities, wherein the quantity of C amongst the unavoidable impurities is restricted to 0.05% or less, and (A3) a member for a supercritical water process reaction apparatus formed from a Ni based alloy with a composition according to either one of (A1) or (A2) above.

As follows is a detailed description of the reasons for restricting the quantity of each element in the compositions of the Ni based alloys according to the aforementioned aspect A of the present invention.

Cr:

In a supercritical water environment containing sulfuric acid, Cr is very effective in promoting corrosion resistance of the aforementioned alloy A. In order to achieve this corrosion resistant effect the quantity of Cr must exceeds 43%, although quantities exceeding 50% make processing of the alloy difficult. Accordingly, the Cr content within a Ni based alloy according to this aspect of the present invention is set to a value within the range from more than 43% to 50% or less, and is preferably from 43.1 to 47%.

Mo:

Mo has a particularly strong effect in improving the corrosion resistance of the alloy A in supercritical water environments containing phosphoric acid. This effect manifests at Mo quantities of at least 0.1%, although at quantities exceeding 2% the phase stability tends to deteriorate. Accordingly, the Mo content within a Ni based alloy according to this aspect of the present invention is set to a value within the range from 0.1 to 2%, and is preferably from more than 0.1% to less than 0.5%.

N, Mn and Mg:

By jointly incorporating N, Mn and Mg, the phase stability of the alloy A can be improved. In other words, N, Mn and Mg stabilize the Ni-fcc matrix, and help to prevent precipitation of a second phase. However, if the N content is less than 0.001%, then the phase stabilizing effect disappears, whereas if the N content exceeds 0.04%, then nitrides are formed, causing a deterioration in the corrosion resistance relative to supercritical water environments containing inorganic acids. Accordingly, the N content is set to a value within the range from 0.001% to 0.04% (and preferably from 0.005% to 0.03%). Similarly, if the Mn content is less than 0.05%, then the phase stabilizing effect disappears, whereas if the Mn content exceeds 0.5%, the corrosion resistance relative to supercritical water environments containing inorganic acids deteriorates. Accordingly, the Mn content is set to a value within the range from 0.05% to 0.5% (and preferably from 0.06% to 0.1%). Similarly, if the Mg content is less than 0.001%, then the phase stabilizing effect disappears, whereas if the Mg content exceeds 0.05%, the corrosion resistance relative to supercritical water environments containing inorganic acids deteriorates. Accordingly, the Mg content is set to a value within the range from 0.001% to 0.05% (and preferably from 0.002% to 0.04%).

Fe and Si:

Fe and Si have a strengthening effect on the aforementioned alloy A, and are consequently added where improved strength is required. Fe displays a strength improvement effect at quantities of at least 0.05%, whereas quantities exceeding 1% result in an undesirable deterioration in the corrosion resistance relative to supercritical water environments containing inorganic acids. Accordingly, the Fe content is set to a value within the range from 0.05% to 1% (and preferably from 0.1% to 0.5%).

Similarly, Si displays a strength improvement effect at quantities of at least 0.01%, whereas quantities exceeding 0.1% result in an undesirable deterioration in the corrosion resistance relative to supercritical water environments containing inorganic acids. Accordingly, the Si content is set to a value within the range from 0.01% to 0.1% (and preferably from 0.02% to 0.08%).

C:

C is incorporated within the alloy A as an unavoidable impurity, and if the quantity is too high, then this C can form carbides with Cr in the vicinity of the grain boundaries, causing a deterioration in the corrosion resistance. As a result, lower C content values are preferred, and the maximum value for the C content within the unavoidable impurities is set at 0.05%.

In addition, the inventors of the present invention then conducted further intensive research aimed at producing a Ni based alloy that displays satisfactory corrosion resistance to the types of supercritical water environments containing inorganic acids described above, and also displays excellent phase stability at 400° C. to 650° C., which would enable operations to be continued for even longer periods. As a result of this research, they discovered that a Ni based alloy comprising Cr: from 29% to less than 42% (all % values refer to % by weight values), Ta: from more than 1% to 3% or less, Mg: 0.001% to 0.05%, N: 0.001% to 0.04%, Mn: 0.05% to 0.5%, where necessary also comprising Mo: 0.1% to 2%, and/or either one, or both, of Fe: 0.05% to 1.0% and Si: 0.01% to 0.1%, and the remainder as Ni and unavoidable impurities, wherein the quantity of C amongst the unavoidable impurities is restricted to 0.05% or less, displays excellent corrosion resistance relative to supercritical water environments containing inorganic acids, and also displays excellent phase stability. Moreover, they also discovered that if this Ni based alloy is used as the material for producing a process reaction apparatus in a system for detoxifying organic toxic materials, then even longer operation of the system becomes possible.

Another aspect B of the present invention is based on these findings, and provides:

(B1) a Ni based alloy with excellent corrosion resistance relative to supercritical water environments containing inorganic acids, comprising Cr: from 29% to less than 42%, Ta: from more than 1% to 3% or less, Mg: 0.001% to 0.05%, N: 0.001% to 0.04%, Mn: 0.05% to 0.5%, and the remainder as Ni and unavoidable impurities, wherein the quantity of C amongst the unavoidable impurities is restricted to 0.05% or less, (B2) a Ni based alloy with excellent corrosion resistance relative to supercritical water environments containing inorganic acids, comprising Cr: from 29% to less than 42%, Ta: from more than 1% to 3% or less, Mg: 0.001% to 0.05%, N:

0.001% to 0.04%, Mn: 0.05% to 0.5%, also comprising Mo: 0.1% to 2%, and the remainder as Ni and unavoidable impurities, wherein the quantity of C amongst the unavoidable impurities is restricted to 0.05% or less, (B3) a Ni based alloy with excellent corrosion resistance relative to supercritical water environments containing inorganic acids, comprising Cr: from 29% to less than 42%, Ta: from more than 1% to 3% or less, Mg: 0.001% to 0.05%, N: 0.001% to 0.04%, Mn: 0.05% to 0.5%, further comprising either one, or both, of Fe: 0.05% to 1.0% and Si: 0.01% to 0.1%, and the remainder as Ni and unavoidable impurities, wherein the quantity of C amongst the unavoidable impurities is restricted to 0.05% or less, (B4) a Ni based alloy with excellent corrosion resistance relative to supercritical water environments containing inorganic acids, comprising Cr: from 29% to less than 42%, Ta: from more than 1% to 3% or less, Mg: 0.001 to 0.05%, N: 0.001 to 0.04%, Mn: 0.05 to 0.5%, also comprising Mo: 0.1 to 2%, further comprising either one, or both, of Fe: 0.05 to 1.0% and Si: 0.01 to 0.1%, and the remainder as Ni and unavoidable impurities, wherein the quantity of C amongst the unavoidable impurities is restricted to 0.05% or less, and (B5) a member for a supercritical water process reaction apparatus formed from a Ni based alloy with a composition according to any one of (B1), (B2), (B3) and (B4) above.

As follows is a detailed description of the reasons for restricting the quantity of each element in the compositions of the Ni based alloys according to this aspect B of the present invention.

Cr and Ta:

In a supercritical water environment containing hydrochloric acid, incorporating both Cr and Ta into the aforementioned Ni based alloy B causes a marked improvement in the corrosion resistance. The quantity of Cr must be at least 29%. However, if the Cr content is 42% or more, then the combination with Ta causes a deterioration in the phase stability, leading to a reduction in the level of corrosion resistance, and consequently the Cr content is set to a value within a range from 29% to less than 42%, and preferably from 30% to less than 38%.

Furthermore, the Ni based alloy B must also contain more than 1% of Ta, although if the Ta content exceeds 3%, then the combination with Cr causes a deterioration in the phase stability, leading to an undesirable reduction in the level of corrosion resistance. Accordingly, the Ta content is set to a value within a range from more than 1% to 3% or less (and preferably from 1.1% to 2.5%).

N and Mn:

By jointly incorporating N and Mn, the phase stability of the Ni based alloy B can be improved. In other words, N and Mn stabilize the Ni-fcc matrix, and help to prevent precipitation of a second phase. However, if the N content is less than 0.001%, then the phase stabilizing effect disappears, whereas if the N content exceeds 0.04%, then nitrides are formed, causing a deterioration in the corrosion resistance relative to supercritical water environments containing inorganic acids. Accordingly, the N content is set to a value within the range from 0.001% to 0.04% (and preferably from 0.005% to 0.03%). Similarly, if the Mn content is less than 0.05%, then the phase stabilizing effect disappears, whereas if the Mn content exceeds 0.5%, the corrosion resistance relative to supercritical water environments containing inorganic acids deteriorates. Accordingly, the Mn content is set to a value within the range from 0.05% to 0.5% (and preferably from 0.06% to 0.1%).

Mg:

Mg is also a component that improves the phase stability of the aforementioned Ni based alloy B, although if the Mg content is less than 0.001%, then the phase stabilizing effect disappears, whereas if the Mg content exceeds 0.05%, then the corrosion resistance relative to supercritical water environments containing inorganic acids deteriorates. Accordingly, the Mg content is set to a value within the range from 0.001% to 0.05% (and preferably from 0.002% to 0.04%).

Mo:

Mo has a particularly strong effect in further improving the corrosion resistance of the Ni based alloy B in supercritical water environments containing hydrochloric acid, and may be added where required. This effect manifests at Mo quantities of at least 0.1%, although at quantities exceeding 2% the phase stability tends to deteriorate. Accordingly, the Mo content within the Ni based alloy of this aspect B is set to a value within the range from 0.1% to 2%, and is preferably from more than 0.1% to less than 0.5%.

Fe and Si:

Fe and Si have a strengthening effect on the aforementioned Ni based alloy B, and are consequently added where improved strength is required. Fe displays a strength improvement effect at quantities of at least 0.05%, whereas quantities exceeding 1% result in an undesirable deterioration in the corrosion resistance relative to supercritical water environments containing inorganic acids. Accordingly, the Fe content is set to a value within the range from 0.05% to 1% (and preferably from 0.1% to 0.5%).

Similarly, Si displays a strength improvement effect at quantities of at least 0.01%, whereas quantities exceeding 0.1% result in an undesirable deterioration in the corrosion resistance relative to supercritical water environments containing inorganic acids. Accordingly, the Si content is set to a value within the range from 0.01% to 0.1% (and preferably from 0.02% to 0.1%).

C:

C is incorporated within the Ni based alloy B as an unavoidable impurity, and if the quantity is too high, then this C can form carbides with Cr in the vicinity of the grain boundaries, causing a deterioration in the corrosion resistance. As a result, lower C content values are preferred, and the maximum value for the C content within the unavoidable impurities is set at 0.05%.

Furthermore, the inventors of the present invention also conducted intensive research aimed at developing a Ni based alloy which does not develop stress corrosion cracking even in supercritical water environments containing inorganic acids, and furthermore also displays excellent phase stability even when maintained at an operating temperature (400° C. to 650° C.) for extended periods, meaning phase transformation can be suppressed and a satisfactory level of resistance to stress corrosion cracking can be ensured even in the above type of supercritical water environments containing inorganic acids. Using this Ni based alloy, the inventors then developed members for a supercritical water process reaction apparatus capable of extended operation in supercritical water environments containing inorganic acids. The results of this research included the following findings:

(Ca) a Ni based alloy comprising Cr: from more than 36% to less than 42% (all % values refer to % by weight values), W: from more than 0.01% to less than 0.5%, Mg: 0.001% to 0.05%, N: 0.001% to 0.04%, Mn: 0.05% to 0.5%, and the remainder as Ni and unavoidable impurities, wherein the quantity of C amongst the unavoidable impurities is restricted to 0.05% or less, displays excellent resistance to stress corrosion cracking in supercritical water environments containing non-chlorine based inorganic acids such as sulfuric acid, phosphoric acid and hydrofluoric acid, and also displays excellent phase stability, and consequently even when maintained at an operating temperature (400° C. to 650° C.) for extended periods, phase transformation can be suppressed and stress corrosion cracking can be prevented, and if this Ni based alloy is used as the material for the reaction apparatus in a system that uses supercritical water for detoxifying organic toxic materials, then even longer operation of the system becomes possible, (Cb) in a Ni based alloy with the composition described above in (Ca), if the relative proportion of the aforementioned remainder portion is reduced and Nb: from more than 1.0% to 6% or less is added, then the resistance to stress corrosion cracking can be further improved, (Cc) in a Ni based alloy with the composition described above in (Ca), if the relative proportion of the aforementioned remainder portion is reduced and either one, or both, of Mo: from 0.01% to less than 0.5% and Hf: 0.01% to 0.1% are added, then the resistance to stress corrosion cracking can be further improved, and (Cd) in a Ni based alloy with the composition described above in (Ca), if the relative proportion of the aforementioned remainder portion is reduced and either one, or both, of Fe: 0.1% to 10% and Si: 0.01% to 0.1% are added, then the strength of the alloy can be improved.

Another aspect C of the present invention is based on these research findings, and provides:

(C1) a Ni based alloy with excellent resistance to stress corrosion cracking in supercritical water environments containing inorganic acids, comprising Cr: from more than 36% to less than 42%, W: from more than 0.01% to less than 0.5%, Mg: 0.001% to 0.05%, N: 0.001% to 0.04%, Mn: 0.05% to 0.5%, and the remainder as Ni and unavoidable impurities, wherein the quantity of C amongst the unavoidable impurities is restricted to 0.05% or less, (C2) a Ni based alloy with excellent resistance to stress corrosion cracking in supercritical water environments containing inorganic acids, comprising Cr: from more than 36% to less than 42%, W: from more than 0.01% to less than 0.5%, Mg: 0.001% to 0.05%, N: 0.001% to 0.04%, Mn: 0.05% to 0.5%, also comprising Nb: from more than 1.0% to 6% or less, and the remainder as Ni and unavoidable impurities, wherein the quantity of C amongst the unavoidable impurities is restricted to 0.05% or less, (C3) a Ni based alloy with excellent resistance to stress corrosion cracking in supercritical water environments containing inorganic acids, comprising Cr: from more than 36% to less than 42%, W: from more than 0.01% to less than 0.5%, Mg: 0.001% to 0.05%, N: 0.001% to 0.04%, Mn: 0.05% to 0.5%, further comprising either one, or both, of Mo: from 0.01% to less than 0.5% and Hf: 0.01% to 0.1%, and the remainder as Ni and unavoidable impurities, wherein the quantity of C amongst the unavoidable impurities is restricted to 0.05% or less, (C4) a Ni based alloy with excellent resistance to stress corrosion cracking in supercritical water environments containing inorganic acids, comprising Cr: from more than 36% to less than 42%, W: from more than 0.01% to less than 0.5%, Mg: 0.001% to 0.05%, N: 0.001% to 0.04%, Mn: 0.05% to 0.5%, further comprising either one, or both, of Fe: 0.1% to 10% and Si: 0.01% to 0.1%, and the remainder as Ni and unavoidable impurities, wherein the quantity of C amongst the unavoidable impurities is restricted to 0.05% or less, (C5) a Ni based alloy with excellent resistance to stress corrosion cracking in supercritical water environments containing inorganic acids, comprising Cr: from more than 36% to less than 42%, W: from more than 0.01% to less than 0.5%, Mg: 0.001% to 0.05%, N: 0.001% to 0.04%, Mn: 0.05% to 0.5%, also comprising Nb: from more than 1.0% to 6% or less, further comprising either one, or both, of Mo: from 0.01% to less than 0.5% and Hf: 0.01% to 0.1%, and the remainder as Ni and unavoidable impurities, wherein the quantity of C amongst the unavoidable impurities is restricted to 0.05% or less, (C6) a Ni based alloy with excellent resistance to stress corrosion cracking in supercritical water environments containing inorganic acids, comprising Cr: from more than 36% to less than 42%, W: from more than 0.01% to less than 0.5%, Mg: 0.001% to 0.05%, N: 0.001% to 0.04%, Mn: 0.05% to 0.5%, also comprising Nb: from more than 1.0% to 6% or less, further comprising either one, or both, of Fe: 0.1% to 10% and Si: 0.01% to 0.1%, and the remainder as Ni and unavoidable impurities, wherein the quantity of C amongst the unavoidable impurities is restricted to 0.05% or less, (C7) a Ni based alloy with excellent resistance to stress corrosion cracking in supercritical water environments containing inorganic acids, comprising Cr: from more than 36% to less than 42%, W: from more than 0.01% to less than 0.5%, Mg: 0.001% to 0.05%, N: 0.001% to 0.04%, Mn: 0.05% to 0.5%, also comprising either one, or both, of Mo: from 0.01% to less than 0.5% and Hf: 0.01% to 0.1%, further comprising either one, or both, of Fe: 0.1% to 10% and Si: 0.01% to 0.1%, and the remainder as Ni and unavoidable impurities, wherein the quantity of C amongst the unavoidable impurities is restricted to 0.05% or less, (C8) a Ni based alloy with excellent resistance to stress corrosion cracking in supercritical water environments containing inorganic acids, comprising Cr: from more than 36% to less than 42%, W: from more than 0.01% to less than 0.5%, Mg: 0.001% to 0.05%, N: 0.001% to 0.04%, Mn: 0.05% to 0.5%, also comprising Nb: from more than 1.0% to 6% or less, further comprising either one, or both, of Mo: from 0.01% to less than 0.5% and Hf: 0.01% to 0.1%, further comprising either one, or both, of Fe: 0.1% to 10% and Si: 0.01% to 0.1%, and the remainder as Ni and unavoidable impurities, wherein the quantity of C amongst the unavoidable impurities is restricted to 0.05% or less, and (C9) a member for a supercritical water process reaction apparatus formed from a Ni based alloy with a composition according to any one of (C1), (C2), (C3), (C4), (C5), (C6), (C7) and (C8) above.

As follows is a detailed description of the reasons for restricting the quantity of each element in the compositions of the Ni based alloys according to this aspect C of the present invention.

Cr and W:

By incorporating a Cr content exceeding 36% and a W content exceeding 0.01% within the Ni based alloy, the resistance to stress corrosion cracking in supercritical water environments containing non-chlorine based inorganic acids such as sulfuric acid, phosphoric acid and hydrofluoric acid can be improved markedly. However if the Cr content is 42% or more, then the combination with W causes a deterioration in the resistance to stress corrosion cracking, and consequently the Cr content is set to a value within a range from more than 36% to less than 42%, and preferably from more than 38% to 41.5% or less. Similarly, if the W content is 0.5% or more, then the combination with Cr causes an undesirable deterioration in the workability of the alloy. Accordingly, the W content is set to a value within a range from more than 0.01% to less than 0.5%, and preferably from 0.1% to 0.45%.

N, Mn and Mg:

By jointly incorporating N, Mn and Mg, the phase stability of the Ni based alloy C can be improved. In other words, N, Mn and Mg stabilize the Ni-fcc matrix, and help to prevent precipitation of a second phase. However, if the N content is less than 0.001%, then the phase stabilizing effect disappears, whereas if the N content exceeds 0.04%, then nitrides are formed, causing a deterioration in the corrosion resistance in supercritical water environments. Accordingly, the N content is set to a value within the range from 0.001% to 0.04% (and preferably from 0.005% to 0.03%). Similarly, if the Mn content is less than 0.05%, then the phase stabilizing effect disappears, whereas if the Mn content exceeds 0.5%, the resistance to stress corrosion cracking in supercritical water environments containing inorganic acids deteriorates. Accordingly, the Mn content is set to a value within the range from 0.05% to 0.5% (and preferably from 0.1% to 0.4%). Similarly, Mg also functions as a component capable of improving the phase stability, although if the Mg content is less than 0.001%, then the phase stabilizing effect disappears, whereas if the Mg content exceeds 0.05%, the resistance to stress corrosion cracking in supercritical water environments containing inorganic acids deteriorates. Accordingly, the Mg content is set to a value within the range from 0.001% to 0.05% (and preferably from 0.010% to 0.040%).

Nb:

By adding Nb to a Ni based alloy with a Cr content exceeding 36% and a W content exceeding 0.01%, the overall corrosion resistance of the alloy in supercritical water environments containing oxygen but containing no chlorine can be further improved, and accordingly Nb can be added as required. The resistance improvement effect manifests at quantities exceeding 1.0%, but if the Nb content exceeds 6%, then the phase stability deteriorates. Accordingly, the Nb content in a Ni based alloy of the aspect C is set to a value within a range from more than 1.0% to 6% or less, and preferably from 1.1% to less than 3.0%.

Mo and Hf:

By adding Mo and Hf to a Ni based alloy with a Cr content exceeding 36% and a W content exceeding 0.01%, the resistance of the alloy to stress corrosion cracking in supercritical water environments containing oxygen but containing no chlorine can be further improved, and accordingly Mo and Hf can be added as required. This effect manifests at Mo quantities exceeding 0.01%, although at quantities of at least 0.5% the phase stability tends to deteriorate, causing an undesirable deterioration in the resistance of the alloy to stress corrosion cracking in supercritical water environments containing inorganic acids. Accordingly, the Mo content is set to a value within the range from more than 0.01% to less than 0.5% (and preferably from more than 0.1% to less than 0.5%).

Similarly, Hf displays a resistance improvement effect at quantities of at least 0.01%, whereas quantities exceeding 0.1% result in an undesirable deterioration in the resistance to stress corrosion cracking in supercritical water environments containing inorganic acids. Accordingly, the Hf content is set to a value within the range from 0.01% to 0.1% (and preferably from 0.02% to 0.05%).

Fe and Si:

Fe and Si have a strengthening effect, and are consequently added where improved strength is required. Fe displays a strength improvement effect at quantities of at least 0.1%, whereas quantities exceeding 10% result in an undesirable deterioration in the overall corrosion resistance in supercritical water environments containing inorganic acids. Accordingly, the Fe content is set to a value within the range from 0.1% to 10% (and preferably from 0.5% to 4%).

Similarly, Si displays a strength improvement effect at quantities of at least 0.01%, whereas quantities exceeding 0.1% result in a deterioration in the phase stability, causing an undesirable deterioration in the resistance to stress corrosion cracking in supercritical water environments containing inorganic acids. Accordingly, the Si content is set to a value within the range from 0.01% to 0.1% (and preferably from 0.02% to 0.05%).

C:

C is incorporated in the alloy as an unavoidable impurity, and if the quantity is too high, then this C can form carbides with Cr in the vicinity of the grain boundaries, causing a general deterioration in the overall corrosion resistance. As a result, lower C content values are preferred, and the maximum value for the C content within the unavoidable impurities is set at 0.05%.

In addition, the inventors of the present invention also conducted intensive research aimed at developing a Ni based alloy which does not develop stress corrosion cracking even in supercritical water environments containing inorganic acids, and furthermore also displays excellent phase stability even when maintained at an operating temperature (400° C. to 650° C.) for extended periods, meaning phase transformation can be suppressed and a satisfactory level of resistance to stress corrosion cracking can be ensured even in the above type of supercritical water environments containing inorganic acids. Using this Ni based alloy, the inventors then developed members for a supercritical water process reaction apparatus capable of extended operation under supercritical water environments containing inorganic acids. The results of this research included the following findings:

(Da) a Ni based alloy comprising Cr: from more than 28% to less than 34% (all % values refer to % by weight values), W: from more than 0.1% to less than 1.0%, Mg: 0.001% to 0.05%, N: 0.001% to 0.04%, Mn: 0.05% to 0.5%, and the remainder as Ni and unavoidable impurities, wherein the quantity of C amongst the unavoidable impurities is restricted to 0.05% or less, displays excellent resistance to stress corrosion cracking in supercritical water environments containing inorganic acids, and particularly supercritical water environments containing chlorine-based inorganic acids, and also displays excellent phase stability, and consequently even when maintained at an operating temperature (400° C. to 650° C.) for extended periods, phase transformation can be suppressed and stress corrosion cracking can be prevented, and if this Ni based alloy is used as the material for the process reaction apparatus in a system that uses supercritical water for detoxifying organic toxic materials, then extended operation of the system becomes possible, (Db) in a Ni based alloy with the composition described above in (Da), if the relative proportion of the aforementioned remainder portion is reduced and Nb: from more than 1.0% to 6% or less is added, then the resistance to stress corrosion cracking can be further improved, (Dc) in a Ni based alloy with the composition described above in (Da), if the relative proportion of the aforementioned remainder portion is reduced and either one, or both, of Mo: from 0.01% to less than 0.5% and Hf: 0.01% to 0.1% are added, then the resistance to stress corrosion cracking can be further improved, and (Dd) in a Ni based alloy with the composition described above in (Da), if the relative proportion of the aforementioned remainder portion is reduced and either one, or both, of Fe: 0.1% to 10% and Si: 0.01% to 0.1% are added, then the strength of the alloy can be improved.

Another aspect D of the present invention is based on these research findings, and provides:

(D1) a Ni based alloy with excellent resistance to stress corrosion cracking in supercritical water environments containing inorganic acids, comprising Cr: from more than 28% to less than 34%, W: from more than 0.1% to less than 1.0%, Mg: 0.001% to 0.05%, N: 0.001% to 0.04%, Mn: 0.05% to 0.5%, and the remainder as Ni and unavoidable impurities, wherein the quantity of C amongst the unavoidable impurities is restricted to 0.05% or less, (D2) a Ni based alloy with excellent resistance to stress corrosion cracking in supercritical water environments containing inorganic acids, comprising Cr: from more than 28% to less than 34%, W: from more than 0.1% to less than 1.0%, Mg: 0.001% to 0.05%, N: 0.001% to 0.04%, Mn: 0.05% to 0.5%, also comprising Nb: from more than 1.0% to 6% or less, and the remainder as Ni and unavoidable impurities, wherein the quantity of C amongst the unavoidable impurities is restricted to 0.05% or less, (D3) a Ni based alloy with excellent resistance to stress corrosion cracking in supercritical water environments containing inorganic acids, comprising Cr: from more than 28% to less than 34%, W: from more than 0.1% to less than 1.0%, Mg: 0.001% to 0.05%, N: 0.001% to 0.04%, Mn: 0.05% to 0.5%, further comprising either one, or both, of Mo: from 0.01% to less than 0.5% and Hf: 0.01% to 0.1%, and the remainder as Ni and unavoidable impurities, wherein the quantity of C amongst the unavoidable impurities is restricted to 0.05% or less, (D4) a Ni based alloy with excellent resistance to stress corrosion cracking in supercritical water environments containing inorganic acids, comprising Cr: from more than 28% to less than 34%, W: from more than 0.1% to less than 1.0%, Mg: 0.001% to 0.05%, N: 0.001% to 0.04%, Mn: 0.05% to 0.5%, further comprising either one, or both, of Fe: 0.1% to 10% and Si: 0.01% to 0.1%, and the remainder as Ni and unavoidable impurities, wherein the quantity of C amongst the unavoidable impurities is restricted to 0.05% or less, (D5) a Ni based alloy with excellent resistance to stress corrosion cracking in supercritical water environments containing inorganic acids, comprising Cr: from more than 28% to less than 34%, W: from more than 0.1% to less than 1.0%, Mg: 0.001% to 0.05%, N: 0.001% to 0.04%, Mn: 0.05% to 0.5%, also comprising Nb: from more than 1.0% to 6% or less, further comprising either one, or both, of Mo: from 0.01% to less than 0.5% and Hf: 0.01% to 0.1%, and the remainder as Ni and unavoidable impurities, wherein the quantity of C amongst the unavoidable impurities is restricted to 0.05% or less, (D6) a Ni based alloy with excellent resistance to stress corrosion cracking in supercritical water environments containing inorganic acids, comprising Cr: from more than 28% to less than 34%, W: from more than 0.1% to less than 1.0%, Mg: 0.001% to 0.05%, N: 0.001% to 0.04%, Mn: 0.05% to 0.5%, also comprising Nb: from more than 1.0% to 6% or less, further comprising either one, or both, of Fe: 0.1% to 10% and Si: 0.01% to 0.1%, and the remainder as Ni and unavoidable impurities, wherein the quantity of C amongst the unavoidable impurities is restricted to 0.05% or less, (D7) a Ni based alloy with excellent resistance to stress corrosion cracking in supercritical water environments containing inorganic acids, comprising Cr: from more than 28% to less than 34%, W: from more than 0.1% to less than 1.0%, Mg: 0.001% to 0.05%, N: 0.001% to 0.04%, Mn: 0.05% to 0.5%, also comprising either one, or both, of Mo: from 0.01% to less than 0.5% and Hf: 0.01% to 0.1%, further comprising either one, or both, of Fe: 0.1% to 10% and Si: 0.01% to 0.1%, and the remainder as Ni and unavoidable impurities, wherein the quantity of C amongst the unavoidable impurities is restricted to 0.05% or less, (D8) a Ni based alloy with excellent resistance to stress corrosion cracking in supercritical water environments containing inorganic acids, comprising Cr: from more than 28% to less than 34%, W: from more than 0.1% to less than 1.0%, Mg: 0.001% to 0.05%, N: 0.001% to 0.04%, Mn: 0.05% to 0.5%, also comprising Nb: from more than 1.0% to 6% or less, further comprising either one, or both, of Mo: from 0.01% to less than 0.5% and Hf: 0.01% to 0.1%, further comprising either one, or both, of Fe: 0.1% to 10% and Si: 0.01% to 0.1%, and the remainder as Ni and unavoidable impurities, wherein the quantity of C amongst the unavoidable impurities is restricted to 0.05% or less, and (D9) a member for a supercritical water process reaction apparatus formed from a Ni based alloy with a composition according to any one of (D1), (D2), (D3), (D4), (D5), (D6), (D7) and (D8) above.

As follows is a detailed description of the reasons for restricting the quantity of each element in the compositions of the Ni based alloys according to this aspect D of the present invention.

Cr and W:

In a supercritical water environment containing hydrochloric acid, the resistance to stress corrosion cracking can be improved markedly by incorporating both Cr and W into the Ni based alloy of the aspect D. The Cr content must exceed 28%. However if the Cr content is 34% or more, then the combination with W causes a deterioration in the overall corrosion resistance, and consequently the Cr content is set to a value within a range from more than 28% to less than 34%, and preferably from 28.5% to less than 33%.

Similarly, the W content in a Ni based alloy of the aspect D must exceed 0.1%. However, if the W content is 1.0% or more then the combination with Cr causes a deterioration in the phase stability, resulting in an undesirable deterioration in the resistance to stress corrosion cracking. Accordingly, the W content is set to a value within a range from more than 0.1% to less than 1.0% (and preferably from more than 0.1% to 0.5% or less).

N, Mn and Mg

By jointly incorporating N, Mn and Mg, the phase stability of the Ni based alloy D can be improved. In other words, N, Mn and Mg stabilize the Ni-fcc matrix, and help to prevent precipitation of a second phase. However, if the N content is less than 0.001%, then the phase stabilizing effect disappears, whereas if the N content exceeds 0.04%, then nitrides are formed, causing a deterioration in the corrosion resistance relative to supercritical water environments. Accordingly, the N content is set to a value within the range from 0.001% to 0.04% (and preferably from 0.005% to 0.03%). Similarly, if the Mn content is less than 0.05%, then the phase stabilizing effect disappears, whereas if the Mn content exceeds 0.5%, the resistance to stress corrosion cracking in supercritical water environments containing inorganic acids deteriorates. Accordingly, the Mn content is set to a value within the range from 0.05% to 0.5% (and preferably from 0.1% to 0.4%). Similarly, Mg also functions as a component capable of improving the phase stability, although if the Mg content is less than 0.001%, then the phase stabilizing effect disappears, whereas if the Mg content exceeds 0.05%, the resistance to stress corrosion cracking in supercritical water environments containing inorganic acids deteriorates. Accordingly, the Mg content is set to a value within the range from 0.001% to 0.05% (and preferably from 0.010% to 0.040%).

Nb:

Nb is effective in improving the overall corrosion resistance of the alloy, particularly in supercritical water environments containing hydrochloric acid, and accordingly is added to the alloy as required. The resistance improvement effect manifests at quantities exceeding 1.0%, but if the Nb content exceeds 6%, then the phase stability deteriorates. Accordingly, the Nb content in a Ni based alloy of the aspect D is set to a value within a range from more than 1.0% to 6% or less, and preferably from 1.1% to less than 3.0%.

Mo and Hf:

Mo and Hf are effective in improving the resistance to stress corrosion cracking, particularly in supercritical water environments containing hydrochloric acid, and accordingly are added to the alloy as required. This effect manifests at Mo quantities exceeding 0.01%, although at quantities of 0.5% or more the phase stability tends to deteriorate, causing an undesirable deterioration in the resistance of the alloy to stress corrosion cracking in supercritical water environments containing inorganic acids. Accordingly, the Mo content is set to a value within the range from more than 0.01% to less than 0.5% (and preferably from more than 0.1% to less than 0.5%).

Similarly, Hf displays a resistance improvement effect at quantities of at least 0.01%, whereas quantities exceeding 0.1% result in an undesirable deterioration in the resistance to stress corrosion cracking in supercritical water environments containing inorganic acids. Accordingly, the Hf content is set to a value within the range from 0.01% to 0.1% (and preferably from 0.02% to 0.05%).

Fe and Si:

Fe and Si have a strengthening effect, and are consequently added where improved strength is required. Fe displays a strength improvement effect at quantities of at least 0.1%, whereas quantities exceeding 10% result in an undesirable deterioration in the overall corrosion resistance in supercritical water environments containing inorganic acids. Accordingly, the Fe content is set to a value within the range from 0.1% to 10% (and preferably from 0.5% to 4.0%).

Similarly, Si displays a strength improvement effect at quantities of at least 0.01%, whereas quantities exceeding 0.1% result in an undesirable deterioration in the phase stability, causing a deterioration in the resistance to stress corrosion cracking in supercritical water environments containing inorganic acids. Accordingly, the Si content is set to a value within the range from 0.01% to 0.1% (and preferably from 0.02% to 0.05%).

C:

C is incorporated in the alloy as an unavoidable impurity, and if the quantity is too high, then this C can form carbides with Cr in the vicinity of the grain boundaries, causing a general deterioration in the overall corrosion resistance. As a result, lower C content values are preferred, and the maximum value for the C content within the unavoidable impurities is set at 0.05%.

DESCRIPTION OF THE INVENTION (Aspect A)

Using a raw material with a low C content in each case, the raw material was melted and cast in a normal high frequency induction furnace to prepare an ingot of thickness 12 mm. The ingot was then subjected to homogenizing heat treatment for 10 hours at 1230° C. Subsequently, with the temperature held within a range from 1000° C. to 1230° C., hot rolling was used to reduce the thickness by 1 mm per repetition, and this process was repeated until a final thickness of 5 mm was achieved. The sample was then subjected to solution treatment by holding the sample at 1200° C. for 30 minutes followed by water quenching. The surface of the sample was then buffed, yielding a Ni based alloy sheet A1 to A21 of the present invention, or a comparative Ni based alloy sheet AC1 to AC11, with a composition shown in Table A1 to Table A3. In addition, using the compositions shown in Table A3, commercially available Ni based alloy sheets AU1 to AU3 of thickness 5 mm were also prepared.

Each of the Ni based alloy sheets A1 to A21 of the present invention, the comparative Ni based alloy sheets AC1 to AC11, and the conventional Ni based alloy sheets AU1 to AU3 was cut to prepare solution test specimens of dimensions 10 mm×50 mm. In addition, in order to evaluate the effect of the phase stability on the corrosion resistance relative to a supercritical water environment containing inorganic acids, each of the Ni based alloy sheets A1 to A21 of the present invention, the comparative Ni based alloy sheets AC1 to AC11, and the conventional Ni based alloy sheets AU1 to AU3 was subjected to aging treatment by holding the sheet at 550° C. for 1000 hours, and the sheet was then cut to prepare aged test specimens of dimensions 10 mm×50 mm.

Next, a flow type corrosion test apparatus was prepared using a Hastelloy C-276 pipe as an autoclave. A test solution is pumped into one end of the Hastelloy C-276 pipe of this flow type corrosion test apparatus using a high pressure pump, and is discharged from the other end of the pipe, while the test solution inside the Hastelloy C-276 pipe is maintained at a predetermined flow rate. The test solution is heated by a heater provided on the Hastelloy C-276 pipe, and the test solution is able to be maintained at a predetermined temperature. In addition, the test solution discharged from the other end of the Hastelloy C-276 pipe of the flow type corrosion test apparatus passes through a pressure reducing valve and is recovered in a reservoir tank.

Using the flow type corrosion test apparatus described above, corrosion tests were conducted using the inorganic acid containing supercritical water simulated solutions described below.

(Aa) A test solution was prepared by mixing 0.2 mol/kg of sulfuric acid and 0.2 mol/kg of phosphoric acid into supercritical water with a fluid temperature of 550° C., a pressure of 40 MPa and a dissolved oxygen level of 8 ppm. This solution is an estimation of the supercritical water solution generated when VX gas is decomposed and oxidized in supercritical water (and is hereafter referred to as a simulated VX gas decomposition supercritical water solution). This simulated VX gas decomposition supercritical water solution was fed into the Hastelloy C-276 pipe of the aforementioned flow type corrosion test apparatus, and the flow rate of the simulated VX gas decomposition supercritical water solution inside the Hastelloy C-276 pipe was adjusted to 6 g/min, thus forming a supercritical water environment containing inorganic acids. Solution test specimens of the Ni based alloy sheets A1 to A21 of the present invention, the comparative Ni based alloy sheets AC1 to AC11, and the conventional Ni based alloy sheets AU1 to AU3 were then each held in this supercritical water environment for a period of 100 hours. The reduction in weight of the solution test specimen over the course of the test was divided by the surface area of the specimen to determine the weight loss per unit area for each test specimen. The results are shown in Table A1 through Table A3.

In addition, in order to evaluate the effect of the phase stability on the corrosion resistance relative to a supercritical water environment containing inorganic acids, aged test specimens of the Ni based alloy sheets A1 to A21 of the present invention, the comparative Ni based alloy sheets AC1 to AC11, and the conventional Ni based alloy sheets AU1 to AU3 were each held in the above supercritical water environment containing inorganic acids for a period of 100 hours. The reduction in weight of the test specimen over the course of the test was divided by the surface area of the aged test specimen to determine the weight loss per unit area for each test specimen. The results are shown in Table A1 through Table A3.

(Ab) A test solution was prepared by mixing 0.4 mol/kg of phosphoric acid and 0.1 mol/kg of hydrofluoric acid into supercritical water with a fluid temperature of 550° C., a pressure of 40 MPa and a dissolved oxygen level of 8 ppm. This solution is an estimation of the supercritical water solution generated when GB (sarin) gas is decomposed and oxidized in supercritical water (and is hereafter referred to as a simulated GB gas decomposition supercritical water solution). This simulated GB gas decomposition supercritical water solution was fed into the Hastelloy C-276 pipe of the aforementioned flow type corrosion test apparatus, and the flow rate of the simulated GB gas decomposition supercritical water solution inside the Hastelloy C-276 pipe was adjusted to 6 g/min, thus forming a supercritical water environment containing inorganic acids. Solution test specimens of the Ni based alloy sheets A1 to A21 of the present invention, the comparative Ni based alloy sheets AC1 to AC11, and the conventional Ni based alloy sheets AU1 to AU3 were then each held in this supercritical water environment for a period of 100 hours. The reduction in weight of the solution test specimen over the course of the test was divided by the surface area of the specimen to determine the weight loss per unit area for each test specimen. The results are shown in Table A1 through Table A3.

In addition, in order to evaluate the effect of the phase stability on the corrosion resistance relative to a supercritical water environment containing inorganic acids, aged test specimens of the Ni based alloy sheets A1 to A21 of the present invention, the comparative Ni based alloy sheets AC1 to AC11, and the conventional Ni based alloy sheets AU1 to AU3 were each held in the above supercritical water environment containing inorganic acids for a period of 100 hours. The reduction in weight of the test specimen over the course of the test was divided by the surface area of the aged test specimen to determine the weight loss per unit area for each test specimen. The results are shown in Table A1 through Table A3.

TABLE A1

| | | Composition (% by weight) | | | | | | | | | Corrosion tests using simulated VX gas decomposition supercritical water solution | | Corrosion tests using simulated GB gas decomposition supercritical water solution | |
|---|---|---|---|---|---|---|---|---|---|---|---|---|---|---|
| Ni based alloy sheet | | Cr | Mo | Mg | N | Mn | Fe | Si | C# | Ni and unavoidable impurities | weight reduction in solution test specimen ($mg/cm^2$) | weight reduction in aged test specimen ($mg/cm^2$) | weight reduction in solution test specimen ($mg/cm^2$) | weight reduction in aged test specimen ($mg/cm^2$) |
| Present | A1 | 44.0 | 1.00 | 0.008 | 0.021 | 0.07 | — | — | 0.02 | remainder | 3 | 4 | 5 | 6 |
| Invention | A2 | 43.1 | 0.31 | 0.006 | 0.008 | 0.22 | — | — | 0.02 | remainder | 7 | 7 | 8 | 8 |
| | A3 | 49.7 | 0.45 | 0.007 | 0.011 | 0.13 | — | — | 0.03 | remainder | 4 | 8 | 3 | 9 |
| | A4 | 44.2 | 0.12 | 0.011 | 0.021 | 0.28 | — | — | 0.02 | remainder | 4 | 6 | 5 | 7 |
| | A5 | 43.2 | 1.96 | 0.021 | 0.013 | 0.10 | — | — | 0.02 | remainder | 5 | 7 | 6 | 8 |
| | A6 | 45.6 | 0.46 | 0.001 | 0.014 | 0.09 | — | — | 0.01 | remainder | 4 | 6 | 2 | 4 |
| | A7 | 44.0 | 0.36 | 0.049 | 0.002 | 0.14 | — | — | 0.02 | remainder | 5 | 9 | 5 | 9 |
| | A8 | 44.5 | 0.35 | 0.022 | 0.039 | 0.12 | — | — | 0.02 | remainder | 4 | 6 | 6 | 7 |
| | A9 | 46.5 | 0.47 | 0.006 | 0.022 | 0.05 | — | — | 0.02 | remainder | 3 | 5 | 7 | 9 |
| | A10 | 45.1 | 0.49 | 0.008 | 0.025 | 0.49 | — | — | 0.01 | remainder | 4 | 6 | 5 | 8 |
| | A11 | 45.6 | 0.48 | 0.031 | 0.018 | 0.13 | 0.05 | — | 0.03 | remainder | 5 | 6 | 6 | 7 |
| | A12 | 43.3 | 0.47 | 0.026 | 0.009 | 0.24 | 0.98 | — | 0.02 | remainder | 4 | 7 | 7 | 9 |
| | A13 | 44.4 | 0.48 | 0.017 | 0.022 | 0.17 | — | 0.01 | 0.02 | remainder | 3 | 5 | 6 | 8 |
| | A14 | 44.1 | 0.46 | 0.004 | 0.022 | 0.11 | — | 0.09 | 0.02 | remainder | 4 | 6 | 5 | 7 |

C# refers to the C quantity incorporated as an unavoidable impurity

TABLE A2

| Ni based alloy sheet | | Composition (% by weight) Cr | Mo | Mg | N | Mn | Fe | Si | C# | Ni and unavoidable impurities | Corrosion tests using simulated VX gas decomposition supercritical water solution: weight reduction in solution test specimen (mg/cm$^2$) | weight reduction in aged test specimen (mg/cm$^2$) | Corrosion tests using simulated GB gas decomposition supercritical water solution: weight reduction in solution test specimen (mg/cm$^2$) | weight reduction in aged test specimen (mg/cm$^2$) |
|---|---|---|---|---|---|---|---|---|---|---|---|---|---|---|
| Present Invention | A15 | 43.5 | 0.47 | 0.040 | 0.034 | 0.17 | — | — | 0.03 | remainder | 5 | 2 | 5 | 3 |
| | A16 | 46.8 | 0.38 | 0.026 | 0.012 | 0.33 | — | — | 0.02 | remainder | 3 | 2 | 4 | 3 |
| | A17 | 44.5 | 0.47 | 0.009 | 0.020 | 0.28 | 0.22 | 0.05 | 0.02 | remainder | 4 | 3 | 4 | 4 |
| | A18 | 46.5 | 0.47 | 0.011 | 0.006 | 0.26 | 0.14 | 0.06 | 0.02 | remainder | 5 | 3 | 5 | 4 |
| | A19 | 45.0 | 0.35 | 0.018 | 0.028 | 0.23 | 0.33 | 0.04 | 0.02 | remainder | 4 | 3 | 5 | 4 |
| | A20 | 43.9 | 0.49 | 0.010 | 0.026 | 0.11 | 0.12 | 0.03 | 0.02 | remainder | 5 | 4 | 6 | 5 |
| | A21 | 44.8 | 0.48 | 0.006 | 0.027 | 0.39 | — | — | 0.01 | remainder | 4 | 2 | 5 | 4 |
| Comparison | AC1 | 42.6* | 0.56 | 0.041 | 0.032 | 0.23 | — | — | 0.02 | remainder | 10 | 11 | 13 | 13 |
| | AC2 | 55.5* | 0.55 | 0.036 | 0.035 | 0.26 | — | — | 0.02 | remainder | 4 | 12 | 5 | 15 |
| | AC3 | 44.5 | —* | 0.044 | 0.034 | 0.33 | — | — | 0.02 | remainder | 7 | 8 | 13 | 15 |
| | AC4 | 45.0 | 2.3* | 0.011 | 0.022 | 0.24 | — | — | 0.03 | remainder | 6 | 15 | 4 | 17 |
| | AC5 | 46.0 | 0.86 | —* | 0.012 | 0.28 | — | — | 0.02 | remainder | 5 | 14 | 5 | 16 |
| | AC6 | 45.5 | 0.65 | 0.060* | 0.015 | 0.20 | — | — | 0.02 | remainder | 5 | 13 | 6 | 15 |
| | AC7 | 45.2 | 0.45 | 0.027 | —* | 0.08 | — | — | 0.02 | remainder | 3 | 14 | 4 | 15 |

*indicates a value outside the composition range of the present invention
C# refers to the C quantity incorporated as an unavoidable impurity

TABLE A3

| Ni based alloy sheet | | Composition (% by weight) Cr | Mo | Mg | N | Mn | Fe | Si | C# | Ni and unavoidable impurities | Corrosion tests using simulated VX gas decomposition supercritical water solution: weight reduction in solution test specimen (mg/cm$^2$) | weight reduction in aged test specimen (mg/cm$^2$) | Corrosion tests using simulated GB gas decomposition supercritical water solution: weight reduction in solution test specimen (mg/cm$^2$) | weight reduction in aged test specimen (mg/cm$^2$) |
|---|---|---|---|---|---|---|---|---|---|---|---|---|---|---|
| Comparison | AC8 | 44.1 | 0.67 | 0.031 | 0.045* | 0.17 | — | — | 0.02 | remainder | 14 | 16 | 15 | 18 |
| | AC9 | 46.3 | 0.45 | 0.024 | 0.019 | 0.04* | — | — | 0.01 | remainder | 4 | 4 | 6 | 16 |
| | AC10 | 44.8 | 0.57 | 0.021 | 0.028 | 0.55* | — | — | 0.02 | remainder | 15 | 16 | 17 | 19 |
| | AC11 | 43.8 | 0.66 | 0.044 | 0.033 | 0.21 | — | — | 0.07* | remainder | 8 | 14 | 9 | 15 |
| Conventional | AU1 | 21.0 | 8.4 | Co: 0.6 | | 0.2 | 3.8 | Ta + Nb: 3.6 | | remainder | 40 | 37 | 57 | 49 |
| | AU2 | 15.5 | 16.1 | W: 3.7, Co: 0.5 | | 0.5 | 5.7 | — | — | remainder | 54 | 45 | 70 | 66 |
| | AU3 | 44.1 | 1.0 | — | | 0.2 | 0.1 | — | — | remainder | 6 | 4 | 35 | 25 |

*indicates a value outside the composition range of the present invention
C# refers to the C quantity incorporated as an unavoidable impurity From the results shown in Table A1 to Table A3 it is evident that both the solution test specimen and the aged test specimen for each of the Ni based alloy sheets A1 to A21 of the present invention displayed a smaller reduction in weight per unit area than either of the conventional Ni based alloy sheets AU1 or AU2, indicating a superior level of corrosion resistance. In addition, compared with the conventional Ni based alloy AU3, the Ni based alloy sheets A1 to A21 of the present invention displayed a smaller reduction in weight per unit area for the aged test specimen. These results confirm the excellent level of corrosion resistance provided by the aged test specimens of the Ni based alloy sheets A1 to A21 of the present invention. Furthermore, in the case of the comparative Ni based alloys AC1 to AC11, which have compositions outside the ranges specified by the present invention, it is evident that either the corrosion resistance of the solution test specimen and/or the corrosion resistance of the aged test specimen is unsatisfactory in each case.

(Aspect B)

Using a raw material with a low C content in each case, the raw material was melted and cast in a normal high frequency induction furnace to prepare an ingot of thickness 12 mm. The ingot was then subjected to homogenizing heat treatment for 10 hours at 1230° C. Subsequently, with the temperature held within a range from 1000 to 1230° C., hot rolling was used to reduce the thickness by 1 mm per repetition, and this process was repeated until a final thickness of 5 mm was achieved. The sample was then subjected to solution treatment by holding the sample at 1200° C. for 30 minutes followed by water quenching. The surface of the sample was then buffed, yielding a Ni based alloy sheet B1 to B21 of the present invention, or a comparative Ni based alloy sheet BC1 to BC11, with a composition shown in Table B1 to Table B3. In addition, using the compositions shown in Table B3, commercially available Ni based alloy sheets BU1 to BU3 of thickness 5 mm were also prepared.

Each of the Ni based alloy sheets B1 to B21 of the present invention, the comparative Ni based alloy sheets BC1 to BC11, and the conventional Ni based alloy sheets BU1 to BU3 was cut to prepare solution test specimens of dimensions 10 mm×50 mm. In addition, in order to evaluate the effect of the phase stability on the corrosion resistance relative to a supercritical water environment containing inorganic acids, each of the Ni based alloy sheets B1 to B21 of the present invention, the comparative Ni based alloy sheets BC1 to BC11, and the conventional Ni based alloy sheets BU1 to BU3 was subjected to aging treatment by holding the sheet at 550° C. for 1000 hours, and the sheet was then cut to prepare aged test specimens of dimensions 10 mm×50 mm.

Next, a flow type corrosion test apparatus was prepared using a Hastelloy C-276 pipe as an autoclave. A test solution is pumped into one end of the Hastelloy C-276 pipe of this flow type corrosion test apparatus using a high pressure pump, and is discharged from the other end of the pipe, while the test solution inside the Hastelloy C-276 pipe is maintained at a predetermined flow rate. The test solution is heated by a heater provided on the Hastelloy C-276 pipe, and the test solution is able to be maintained at a predetermined temperature. In addition, the test solution discharged from the other end of the Hastelloy C-276 pipe of the flow type corrosion test apparatus passes through a pressure reducing valve and is recovered in a reservoir tank.

Using the flow type corrosion test apparatus described above, corrosion tests were conducted using the inorganic acid containing supercritical water simulated solution described below. Namely, a test solution was prepared by mixing 0.05 mol/kg of hydrochloric acid into supercritical water with a fluid temperature of 550° C., a pressure of 40 MPa and a dissolved oxygen level of 8 ppm. This solution is an estimation of the supercritical water solution generated when PCBs or dioxin are decomposed and oxidized in supercritical water (and is hereafter referred to as a simulated PCB or dioxin decomposition supercritical water solution). This simulated PCB or dioxin decomposition supercritical water solution was fed into the Hastelloy C-276 pipe of the aforementioned flow type corrosion test apparatus, and the flow rate of the simulated PCB or dioxin decomposition supercritical water solution inside the Hastelloy C-276 pipe was adjusted to 6 g/min, thus forming a supercritical water environment containing an inorganic acid. Solution test specimens of the Ni based alloy sheets B1 to B21 of the present invention, the comparative Ni based alloy sheets BC1 to BC11, and the conventional Ni based alloy sheets BU1 to BU3 were then each held in this supercritical water environment for a period of 100 hours. The surface of each test specimen was then inspected for pitting. The results are shown in Table B1 through Table B3.

In addition, in order to evaluate the effect of the phase stability on the corrosion resistance relative to a supercritical water environment containing this inorganic acid, aged test specimens of the Ni based alloy sheets B1 to B21 of the present invention, the comparative Ni based alloy sheets BC1 to BC11, and the conventional Ni based alloy sheets BU1 to BU3 were each held in the above supercritical water environment containing an inorganic acid for a period of 100 hours. The surface of each aged test specimen was then inspected for pitting. The results are shown in Table B1 through Table B3.

TABLE B1

| Ni based alloy sheet | | Composition (% by weight) | | | | | | | | | | Corrosion tests using simulated PCB or dioxin decomposition supercritical water solution | |
|---|---|---|---|---|---|---|---|---|---|---|---|---|---|
| | | Cr | Ta | Mg | N | Mn | Mo | Fe | Si | C# | Ni and unavoidable impurities | presence of pitting in solution test specimen | presence of pitting in aged test specimen |
| Present Invention | B1 | 30.7 | 2.01 | 0.016 | 0.012 | 0.18 | — | 0.12 | 0.021 | 0.02 | remainder | no | no |
| | B2 | 29.3 | 2.41 | 0.014 | 0.008 | 0.24 | — | — | — | 0.02 | remainder | no | no |
| | B3 | 41.6 | 1.01 | 0.019 | 0.011 | 0.14 | — | — | — | 0.01 | remainder | no | no |
| | B4 | 37.6 | 1.11 | 0.011 | 0.021 | 0.29 | — | — | — | 0.02 | remainder | no | no |
| | B5 | 33.4 | 2.96 | 0.012 | 0.013 | 0.14 | — | — | — | 0.02 | remainder | no | no |
| | B6 | 37.6 | 1.48 | 0.001 | 0.014 | 0.19 | — | — | — | 0.02 | remainder | no | no |
| | B7 | 34.2 | 2.36 | 0.049 | 0.007 | 0.16 | — | — | — | 0.02 | remainder | no | no |
| | B8 | 34.7 | 2.34 | 0.016 | 0.002 | 0.17 | — | — | — | 0.01 | remainder | no | no |
| | B9 | 36.4 | 1.87 | 0.023 | 0.039 | 0.11 | — | — | — | 0.02 | remainder | no | no |
| | B10 | 35.2 | 1.96 | 0.026 | 0.025 | 0.05 | — | — | — | 0.02 | remainder | no | no |
| | B11 | 35.3 | 2.38 | 0.021 | 0.018 | 0.49 | — | — | — | 0.02 | remainder | no | no |
| | B12 | 33.6 | 1.77 | 0.018 | 0.029 | 0.24 | 0.11 | — | — | 0.02 | remainder | no | no |
| | B13 | 34.8 | 1.98 | 0.015 | 0.020 | 0.16 | 1.98 | — | — | 0.02 | remainder | no | no |
| | B14 | 34.1 | 1.76 | 0.033 | 0.025 | 0.11 | — | 0.5 | — | 0.02 | remainder | no | no |

C# refers to the C quantity incorporated as an unavoidable impurity

TABLE B2

| Ni based alloy sheet | | Composition (% by weight) Cr | Ta | Mg | N | Mn | Mo | Fe | Si | C# | Ni and unavoidable impurities | Corrosion tests using simulated PCB or dioxin decomposition supercritical water solution: presence of pitting in solution test specimen | presence of pitting in aged test specimen |
|---|---|---|---|---|---|---|---|---|---|---|---|---|---|
| Present Invention | B15 | 33.7 | 1.87 | 0.031 | 0.030 | 0.16 | — | 0.99 | — | 0.02 | remainder | no | no |
| | B16 | 34.8 | 2.34 | 0.026 | 0.017 | 0.38 | — | — | 0.01 | 0.02 | remainder | no | no |
| | B17 | 34.8 | 2.17 | 0.028 | 0.021 | 0.18 | — | — | 0.09 | 0.03 | remainder | no | no |
| | B18 | 32.5 | 2.27 | 0.030 | 0.006 | 0.26 | 0.21 | 0.14 | — | 0.02 | remainder | no | no |
| | B19 | 35.1 | 1.75 | 0.032 | 0.028 | 0.23 | — | 0.33 | 0.06 | 0.01 | remainder | no | no |
| | B20 | 34.1 | 1.69 | 0.021 | 0.013 | 0.11 | 0.22 | — | 0.04 | 0.02 | remainder | no | no |
| | B21 | 34.7 | 1.76 | 0.023 | 0.027 | 0.39 | 0.31 | 0.24 | 0.03 | 0.01 | remainder | no | no |
| Comparison | BC1 | 28.5* | 1.56 | 0.018 | 0.032 | 0.24 | — | — | — | 0.02 | remainder | yes | yes |
| | BC2 | 43.5* | 1.86 | 0.015 | 0.035 | 0.21 | — | — | — | 0.02 | remainder | no | yes |
| | BC3 | 32.5 | —* | 0.014 | 0.034 | 0.13 | — | — | — | 0.02 | remainder | yes | yes |
| | BC4 | 35.0 | 3.30* | 0.017 | 0.022 | 0.27 | — | — | — | 0.01 | remainder | no | yes |
| | BC5 | 36.2 | 1.83 | —* | 0.012 | 0.38 | — | — | — | 0.02 | remainder | no | yes |
| | BC6 | 35.4 | 1.62 | 0.055* | 0.015 | 0.22 | — | — | — | 0.02 | remainder | yes | yes |
| | BC7 | 35.7 | 1.45 | 0.022 | —* | 0.09 | — | — | — | 0.02 | remainder | no | yes |

*indicates a value outside the composition range of the present invention
C# refers to the C quantity incorporated as an unavoidable impurity

TABLE B3

| Ni based alloy sheet | | Composition (% by weight) Cr | Ta | Mg | N | Mn | Mo | Fe | Si | C# | Ni and unavoidable impurities | Corrosion tests using simulated PCB or dioxin decomposition supercritical water solution: presence of pitting in solution test specimen | presence of pitting in aged test specimen |
|---|---|---|---|---|---|---|---|---|---|---|---|---|---|
| Comparison | BC8 | 34.8 | 1.67 | 0.024 | 0.045* | 0.37 | — | — | — | 0.01 | remainder | yes | yes |
| | BC9 | 36.1 | 1.45 | 0.016 | 0.019 | 0.04* | — | — | — | 0.01 | remainder | no | yes |
| | BC10 | 34.2 | 1.57 | 0.017 | 0.028 | 0.55* | — | — | — | 0.02 | remainder | yes | yes |
| | BC11 | 35.5 | 1.21 | 0.022 | 0.018 | 0.39 | — | — | — | 0.07* | remainder | no | yes |
| Conventional | BU1 | 21.0 | 8.4 | Co: 0.6 | | 0.2 | — | 3.8 | Ta + Nb: 3.6 | | remainder | yes | yes |
| | BU2 | 15.5 | 16.1 | W: 3.7, Co: 0.5 | | 0.5 | — | 5.7 | — | — | remainder | yes | yes |
| | BU3 | 44.1 | 1.0 | — | | 0.2 | — | 0.1 | — | — | remainder | no | yes |

*indicates a value outside the composition range of the present invention
C# refers to the C quantity incorporated as an unavoidable impurity From the results shown in Table B1 to Table B3 it is evident that both the solution test specimen and the aged test specimen for each of the Ni based alloy sheets B1 to B21 of the present invention displayed far less pitting than either of the conventional Ni based alloy sheets BU1 or BU2, indicating a superior level of corrosion resistance. However, in the case of the comparative Ni based alloy sheets BC1 to BC11, which have compositions outside the ranges specified by the present invention, it is evident that either the corrosion resistance of the solution test specimen and/or the corrosion resistance of the aged test specimen is unsatisfactory in each case.

(Aspect C)

Raw material was melted and cast in a normal high frequency induction furnace to prepare ingots of thickness 12 mm, with the compositions shown in Table C1 through Table C4. Each ingot was then subjected to homogenizing heat treatment for 10 hours at 1230° C. Subsequently, with the temperature held within a range from 1000 to 1230° C., hot rolling was used to reduce the thickness by 1 mm per repetition, and this process was repeated until a final thickness of 5 mm was achieved. Each sample was then subjected to solution treatment by holding the sample at 1200° C. for 30 minutes followed by water quenching. The surface of each sample was then polished using emery paper #600, yielding a series of Ni based alloy sheets C1 to C42 of the present invention, a series of comparative Ni based alloy sheets CC1 to CC11, and a series of conventional Ni based alloy sheets CU1 to CU3.

In order to impart internal stress and internal distortion to each of the Ni based alloy sheets C1 to C42 of the present invention, each of the comparative Ni based alloy sheets CC1 to CC11, and each of the conventional Ni based alloy sheets CU1 to CU3, each alloy sheet was subjected to cold rolling with a draft of 30%, yielding a sheet of thickness 3.5 mm in each case. Each of these sheets was then cut to prepare a series of rectangular block type solution test specimens, with dimensions of length 4 mm, width 4 mm and height 3.5 mm.

In addition, the method described below was used to evaluate the effect of the phase stability on the resistance to stress corrosion cracking in a supercritical water environment containing inorganic acids. First, each of the Ni based alloy sheets C1 to C42 of the present invention, the comparative Ni based alloy sheets CC1 to CC11, and the conventional Ni based alloy sheets CU1 to CU3 was subjected to aging treatment by holding the sheet at 450° C. for 10,000 hours. The sheet was then polished using emery paper #600, and was subsequently subjected to cold rolling with a draft of 30% to impart internal stress and internal distortion to the sheet, thereby yielding a sheet of thickness 3.5 mm in each case. Each of these sheets was then cut to prepare a series of rectangular block type aged test specimens, with dimensions of length 4 mm, width 4 mm and height 3.5 mm.

Next, a flow type corrosion test apparatus was prepared using a titanium/Hastelloy C-276 double layered pipe comprising titanium on the inside and Hastelloy C-276 on the outside as an autoclave. A test solution is pumped into one end of the titanium/Hastelloy C-276 double layered pipe of this flow type corrosion test apparatus using a high pressure pump, and by heating the test solution with a heater provided at the end of the pipe, predetermined corrosion test conditions can be established. The test solution is discharged from the other end of the pipe, passes through a pressure reducing valve and is recovered in a reservoir tank.

A test solution was prepared by mixing 0.2 mol/kg of sulfuric acid and 0.2 mol/kg of phosphoric acid into supercritical water with a fluid temperature of 500° C., a pressure of 60 MPa and a dissolved oxygen level of 800 ppm (achieved by adding hydrogen peroxide). This supercritical water containing sulfuric acid and phosphoric acid is an estimation of the supercritical water solution generated when VX gas is decomposed and oxidized in supercritical water, and hereafter, this supercritical water solution containing sulfuric acid and phosphoric acid is referred to as a simulated VX gas decomposition solution.

In addition, another test solution was prepared by mixing 0.4 mol/kg of phosphoric acid and 0.14 mol/kg of hydrofluoric acid into supercritical water with a fluid temperature of 500° C., a pressure of 60 MPa and a dissolved oxygen level of 800 ppm (achieved by adding hydrogen peroxide). This supercritical water containing phosphoric acid and hydrofluoric acid is an estimation of the supercritical water solution generated when GB (sarin) gas is decomposed and oxidized in supercritical water, and hereafter, this supercritical water solution containing phosphoric acid and hydrofluoric acid is referred to as a simulated GB gas decomposition solution.

The simulated VX gas decomposition solution and the simulated GB gas decomposition solution were fed into the titanium/Hastelloy C-276 double layered pipe of the aforementioned flow type corrosion test apparatus, and the flow rate of the simulated VX gas decomposition solution or simulated GB gas decomposition solution inside the double layered pipe was adjusted to 6 g/min, thus forming a supercritical water environment containing inorganic acids. Solution test specimens of the Ni based alloy sheets C1 to C42 of the present invention, the comparative Ni based alloy sheets CC1 to CC11, and the conventional Ni based alloy sheets CU1 to CU3 were then each held in this supercritical water environment for a period of 100 hours. The surface of each test specimen was then inspected for stress corrosion cracking. The results are shown in Table C5 and Table C6.

In addition, in order to evaluate the effect of the phase stability on the resistance to stress corrosion cracking in a supercritical water environment containing inorganic acids, aged test specimens of the Ni based alloy sheets C1 to C42 of the present invention, the comparative Ni based alloy sheets CC1 to CC11, and the conventional Ni based alloy sheets CU1 to CU3 were each held in the above supercritical water environment containing inorganic acids for a period of 100 hours. The surface of each aged test specimen was then inspected for stress corrosion cracking. The results are shown in Table C5 and Table C6.

TABLE C1

| Ni based | | Composition (% by weight) (Remainder: Ni and unavoidable impurities) | | | | | | | | | | |
|---|---|---|---|---|---|---|---|---|---|---|---|---|
| alloy sheet | | Cr | W | Mg | N | Mn | Nb | Mo | Hf | Fe | Si | C# |
| Present Invention | C1 | 36.1 | 0.32 | 0.0145 | 0.008 | 0.27 | — | — | — | — | — | 0.02 |
| | C2 | 41.9 | 0.45 | 0.016 | 0.010 | 0.13 | — | — | — | — | — | 0.01 |
| | C3 | 39.3 | 0.02 | 0.014 | 0.021 | 0.29 | — | — | — | — | — | 0.02 |
| | C4 | 38.2 | 0.48 | 0.015 | 0.015 | 0.25 | — | — | — | — | — | 0.02 |
| | C5 | 40.4 | 0.48 | 0.002 | 0.011 | 0.14 | — | — | — | — | — | 0.02 |
| | C6 | 39.4 | 0.36 | 0.038 | 0.007 | 0.12 | — | — | — | — | — | 0.02 |
| | C7 | 40.3 | 0.45 | 0.027 | 0.001 | 0.18 | — | — | — | — | — | 0.02 |
| | C8 | 41.4 | 0.24 | 0.014 | 0.039 | 0.14 | — | — | — | — | — | 0.01 |
| | C9 | 38.2 | 0.36 | 0.033 | 0.026 | 0.06 | — | — | — | — | — | 0.02 |
| | C10 | 39.1 | 0.38 | 0.024 | 0.018 | 0.49 | — | — | — | — | — | 0.02 |
| | C11 | 40.2 | 0.14 | 0.012 | 0.011 | 0.16 | 1.4 | — | — | 0.26 | 0.024 | 0.02 |
| | C12 | 40.7 | 0.27 | 0.019 | 0.027 | 0.20 | 1.04 | — | — | — | — | 0.02 |
| | C13 | 37.8 | 0.29 | 0.017 | 0.024 | 0.25 | 5.96 | — | — | — | — | 0.02 |
| | C14 | 37.7 | 0.37 | 0.027 | 0.031 | 0.19 | 3.6 | — | — | — | — | 0.02 |

C# refers to the C quantity incorporated as an unavoidable impurity

TABLE C2

| Ni based | | Composition (% by weight) (Remainder: Ni and unavoidable impurities) | | | | | | | | | | |
|---|---|---|---|---|---|---|---|---|---|---|---|---|
| alloy sheet | | Cr | W | Mg | N | Mn | Nb | Mo | Hf | Fe | Si | C# |
| Present Invention | C15 | 38.3 | 0.32 | 0.015 | 0.007 | 0.23 | 4.5 | — | — | — | — | 0.02 |
| | C16 | 41.1 | 0.37 | 0.032 | 0.027 | 0.14 | 2.1 | 0.01 | — | — | — | 0.02 |
| | C17 | 37.7 | 0.37 | 0.027 | 0.031 | 0.19 | — | 0.49 | — | — | — | 0.01 |

TABLE C2-continued

| Ni based alloy sheet | | Composition (% by weight) (Remainder: Ni and unavoidable impurities) | | | | | | | | | | |
|---|---|---|---|---|---|---|---|---|---|---|---|---|
| | | Cr | W | Mg | N | Mn | Nb | Mo | Hf | Fe | Si | C# |
| | C18 | 38.2 | 0.96 | 0.013 | 0.014 | 0.15 | — | 0.15 | — | — | — | 0.02 |
| | C19 | 39.4 | 0.48 | 0.001 | 0.013 | 0.18 | — | 0.23 | — | — | — | 0.02 |
| | C20 | 31.2 | 0.36 | 0.048 | 0.008 | 0.17 | — | 0.34 | — | — | — | 0.02 |
| | C21 | 39.8 | 0.04 | 0.023 | 0.014 | 0.26 | 2.9 | — | 0.01 | — | — | 0.02 |
| | C22 | 39.2 | 0.17 | 0.029 | 0.026 | 0.17 | — | — | 0.09 | — | — | 0.03 |
| | C23 | 38.2 | 0.36 | 0.026 | 0.025 | 0.05 | — | — | 0.03 | — | — | 0.02 |
| | C24 | 39.3 | 0.38 | 0.020 | 0.019 | 0.49 | — | — | 0.05 | — | — | 0.02 |
| | C25 | 37.2 | 0.44 | 0.012 | 0.011 | 0.18 | — | — | 0.07 | — | — | 0.02 |
| | C26 | 39.5 | 0.37 | 0.031 | 0.007 | 0.21 | — | 0.24 | 0.03 | — | — | 0.02 |
| | C27 | 38.1 | 0.45 | 0.034 | 0.027 | 0.24 | — | — | — | 0.12 | — | 0.02 |
| | C28 | 36.1 | 0.03 | 0.023 | 0.019 | 0.13 | — | — | — | 9.89 | — | 0.02 |

C# refers to the C quantity incorporated as an unavoidable impurity

TABLE C3

| Ni based alloy sheet | | Composition (% by weight) (Remainder: Ni and unavoidable impurities) | | | | | | | | | | |
|---|---|---|---|---|---|---|---|---|---|---|---|---|
| | | Cr | W | Mg | N | Mn | Nb | Mo | Hf | Fe | Si | C# |
| Present Invention | C29 | 38.3 | 0.32 | 0.015 | 0.007 | 0.23 | — | — | — | 2.85 | — | 0.02 |
| | C30 | 39.6 | 0.45 | 0.017 | 0.011 | 0.14 | — | — | — | 5.11 | — | 0.02 |
| | C31 | 37.6 | 0.11 | 0.015 | 0.020 | 0.28 | — | — | — | 6.38 | — | 0.01 |
| | C32 | 39.7 | 0.18 | 0.027 | 0.025 | 0.26 | — | — | — | — | 0.01 | 0.02 |
| | C33 | 38.8 | 0.43 | 0.024 | 0.034 | 0.19 | — | — | — | — | 0.09 | 0.02 |
| | C34 | 38.2 | 0.36 | 0.048 | 0.008 | 0.17 | — | — | — | — | 0.05 | 0.02 |
| | C35 | 39.6 | 0.45 | 0.030 | 0.030 | 0.14 | — | — | — | 0.27 | 0.03 | 0.02 |
| | C36 | 40.2 | 0.22 | 0.044 | 0.021 | 0.21 | 1.88 | 0.34 | 0.02 | — | 0.02 | 0.01 |
| | C37 | 41.3 | 0.47 | 0.032 | 0.028 | 0.13 | 2.03 | — | 0.05 | 1.27 | 0.02 | 0.02 |
| | C38 | 41.9 | 0.24 | 0.019 | 0.031 | 0.17 | 1.63 | — | — | 2.58 | — | 0.01 |
| | C39 | 40.6 | 0.18 | 0.029 | 0.025 | 0.12 | 1.22 | — | — | — | 0.07 | 0.02 |
| | C40 | 39.6 | 0.36 | 0.027 | 0.020 | 0.16 | 1.56 | — | 0.04 | — | — | 0.02 |
| | C41 | 39.1 | 0.36 | 0.030 | 0.024 | 0.12 | — | 0.31 | — | 3.2 | — | 0.02 |
| | C42 | 39.7 | 0.67 | 0.031 | 0.030 | 0.16 | — | — | 0.05 | — | 0.02 | 0.02 |

C# refers to the C quantity incorporated as an unavoidable impurity

TABLE C4

| Ni based alloy sheet | | Composition (% by weight) (Remainder: Ni and unavoidable impurities) | | | | | | | | |
|---|---|---|---|---|---|---|---|---|---|---|
| | | Cr | W | Mg | N | Mn | Mo | Fe | Si | C# |
| Comparison | CC1 | 35.5* | 0.36 | 0.021 | 0.038 | 0.24 | — | — | — | 0.01 |
| | CC2 | 42.5* | 0.45 | 0.026 | 0.035 | 0.26 | — | — | — | 0.01 |
| | CC3 | 39.4 | —* | 0.035 | 0.031 | 0.15 | — | — | — | 0.02 |
| | CC4 | 42.0 | 0.60* | 0.019 | 0.025 | 0.29 | — | — | — | 0.02 |
| | CC5 | 39.2 | 0.13 | —* | 0.017 | 0.38 | — | — | — | 0.02 |
| | CC6 | 39.4 | 0.32 | 0.055* | 0.016 | 0.22 | — | — | — | 0.02 |
| | CC7 | 40.7 | 0.45 | 0.029 | —* | 0.08 | — | — | — | 0.02 |
| | CC8 | 39.8 | 0.47 | 0.021 | 0.046* | 0.39 | — | — | — | 0.01 |
| | CC9 | 41.1 | 0.45 | 0.026 | 0.022 | 0.04* | — | — | — | 0.01 |
| | CC10 | 39.2 | 0.37 | 0.019 | 0.025 | 0.55* | — | — | — | 0.02 |
| | CC11 | 39.2 | 0.44 | 0.022 | 0.021 | 0.18 | — | — | — | 0.07* |
| Conventional | CU1 | 21.0 | — | | Co: 0.6 | 0.2 | 8.4 | 3.8 | | — |
| | CU2 | 15.5 | 3.7 | | Co: 0.5 | 0.5 | 16.1 | 5.7 | | — |
| | CU3 | 28.7 | 2.6 | | Co: 1.87 | 1.1 | 5.0 | 14.6 | | Cu: 1.8 |

*indicates a value outside the composition range of the present invention
C# refers to the C quantity incorporated as an unavoidable impurity

TABLE C5

| Ni based alloy sheet | | Corrosion test results using simulated VX gas decomposition solution | | Corrosion test results using simulated GB gas decomposition solution | |
|---|---|---|---|---|---|
| | | Presence of stress corrosion cracking in solution test specimen | Presence of stress corrosion cracking in aged test specimen | Presence of stress corrosion cracking in solution test specimen | Presence of stress corrosion cracking in aged test specimen |
| Present Invention | C1 | no | no | no | no |
| | C2 | no | no | no | no |
| | C3 | no | no | no | no |
| | C4 | no | no | no | no |
| | C5 | no | no | no | no |
| | C6 | no | no | no | no |
| | C7 | no | no | no | no |
| | C8 | no | no | no | no |
| | C9 | no | no | no | no |
| | C10 | no | no | no | no |
| | C11 | no | no | no | no |
| | C12 | no | no | no | no |
| | C13 | no | no | no | no |
| | C14 | no | no | no | no |
| | C15 | no | no | no | no |
| | C16 | no | no | no | no |
| | C17 | no | no | no | no |
| | C18 | no | no | no | no |
| | C19 | no | no | no | no |
| | C20 | no | no | no | no |
| | C21 | no | no | no | no |
| | C22 | no | no | no | no |
| | C23 | no | no | no | no |
| | C24 | no | no | no | no |
| | C25 | no | no | no | no |
| | C26 | no | no | no | no |
| | C27 | no | no | no | no |
| | C28 | no | no | no | no |

TABLE C6

| Ni based alloy sheet | | Corrosion test results using simulated VX gas decomposition solution | | Corrosion test results using simulated GB gas decomposition solution | | Remarks |
|---|---|---|---|---|---|---|
| | | Presence of stress corrosion cracking in solution test specimen | Presence of stress corrosion cracking in aged test specimen | Presence of stress corrosion cracking in solution test specimen | Presence of stress corrosion cracking in aged test specimen | |
| Present Invention | C29 | no | no | no | no | — |
| | C30 | no | no | no | no | — |
| | C31 | no | no | no | no | — |
| | C32 | no | no | no | no | — |
| | C33 | no | no | no | no | — |
| | C34 | no | no | no | no | — |
| | C35 | no | no | no | no | — |
| | C36 | no | no | no | no | — |
| | C37 | no | no | no | no | — |
| | C38 | no | no | no | no | — |
| | C39 | no | no | no | no | — |
| | C40 | no | no | no | no | — |
| | C41 | no | no | no | no | — |
| | C42 | no | no | no | no | — |
| Comparison | CC1 | no | yes | no | yes | — |
| | CC2 | no | — | no | — | cracked during cold rolling |
| | CC3 | no | yes | no | yes | — |
| | CC4 | no | — | no | — | cracked during cold rolling |
| | CC5 | no | yes | no | yes | — |
| | CC6 | no | yes | no | yes | — |
| | CC7 | no | yes | no | yes | — |

TABLE C6-continued

| Ni based alloy sheet | | Corrosion test results using simulated VX gas decomposition solution | | Corrosion test results using simulated GB gas decomposition solution | | Remarks |
|---|---|---|---|---|---|---|
| | | Presence of stress corrosion cracking in solution test specimen | Presence of stress corrosion cracking in aged test specimen | Presence of stress corrosion cracking in solution test specimen | Presence of stress corrosion cracking in aged test specimen | |
| | CC8 | yes | yes | yes | yes | — |
| | CC9 | no | yes | no | yes | — |
| | CC10 | no | yes | no | yes | — |
| | CC11 | no | yes | no | yes | — |
| Conventional | CU1 | yes | yes | yes | yes | — |
| | CU2 | yes | yes | yes | yes | — |
| | CU3 | no | yes | no | yes | — |

From the results shown in Table C1 to Table C6 it is evident that both the solution test specimen and the aged test specimen for each of the Ni based alloy sheets C1 to C42 of the present invention displayed none of the stress corrosion cracking seen in the conventional Ni based alloy sheets CU1 and CU2, indicating a superior level of resistance to stress corrosion cracking. However, in the case of the comparative Ni based alloy sheets CC1 to CC11, which have compositions outside the ranges specified by the present invention, it is evident that stress corrosion cracking developed in either the solution test specimen and/or the aged test specimen, and there was also a marked increase in overall corrosion.

(Aspect D)

Raw material was melted and cast in a normal high frequency induction furnace to prepare ingots of thickness 12 mm, with the compositions shown in Table D1 through Table D4. Each ingot was then subjected to homogenizing heat treatment for 10 hours at 1230° C. Subsequently, with the temperature held within a range from 1000 to 1230° C., hot rolling was used to reduce the thickness by 1 mm per repetition, and this process was repeated until a final thickness of 5 mm was achieved. Each sample was then subjected to solution treatment by holding the sample at 1200° C. for 30 minutes followed by water quenching. The surface of each sample was then buffed, yielding a series of Ni based alloy sheets D1 to D42 of the present invention, a series of comparative Ni based alloy sheets DC1 to DC11, and a series of conventional Ni based alloy sheets DU1 to DU3.

In order to impart internal stress and internal distortion to each of the Ni based alloy sheets D1 to D42 of the present invention, each of the comparative Ni based alloy sheets DC1 to DC11, and each of the conventional Ni based alloy sheets DU1 to DU3, each alloy sheet was subjected to cold rolling with a draft of 20%, yielding a sheet of thickness 4 mm in each case. Each of these sheets was then cut to prepare a series of cube-like solution test specimens, with dimensions of length 4 mm, width 4 mm and height 4 mm.

In addition, the method described below was used to evaluate the effect of the phase stability on the resistance to stress corrosion cracking in a supercritical water environment containing inorganic acids. First, each of the Ni based alloy sheets D1 to D42 of the present invention, the comparative Ni based alloy sheets DC1 to DC11, and the conventional Ni based alloy sheets DU1 to DU3 was subjected to aging treatment by holding the sheet at 500° C. for 1000 hours. The sheet was then subjected to cold rolling with a draft of 20% to impart internal stress and internal distortion to the sheet, thereby yielding a sheet of thickness 4 mm in each case. Each of these sheets was then cut to prepare a series of cube-like aged test specimens, with dimensions of length 4 mm, width 4 mm and height 4 mm.

Next, a flow type corrosion test apparatus was prepared using a titanium/Hastelloy C-276 double layered pipe comprising titanium on the inside and Hastelloy C-276 on the outside as an autoclave. A test solution is pumped into one end of the titanium/Hastelloy C-276 double layered pipe of this flow type corrosion test apparatus using a high pressure pump, and by heating the test solution with a heater provided at the end of the pipe, predetermined corrosion test conditions can be established. The test solution is discharged from the other end of the pipe, passes through a pressure reducing valve and is recovered in a reservoir tank.

A test solution was prepared by mixing 0.03 mol/kg of hydrochloric acid into supercritical water with a fluid temperature of 500° C., a pressure of 60 MPa and a dissolved oxygen level of 800 ppm (achieved by adding hydrogen peroxide).

This supercritical water containing hydrochloric acid is an estimation of the supercritical water solution generated when PCBs or dioxin are decomposed and oxidized in supercritical water, and hereafter, this supercritical water solution containing hydrochloric acid is referred to as a simulated PCB or dioxin decomposition solution.

This simulated PCB or dioxin decomposition solution was fed into the titanium/Hastelloy C-276 double layered pipe of the aforementioned flow type corrosion test apparatus, and the flow rate of the simulated PCB or dioxin decomposition solution inside the double layered pipe was adjusted to 6 g/min, thus forming a supercritical water environment containing an inorganic acid. Solution test specimens of the Ni based alloy sheets D1 to D42 of the present invention, the comparative Ni based alloy sheets DC1 to DC11, and the conventional Ni based alloy sheets DU1 to DU3 were then each held in this supercritical water environment for a period of 100 hours. The surface of each test specimen was then inspected for stress corrosion cracking. The results are shown in Table D1 through Table D4.

In addition, in order to evaluate the effect of the phase stability on the resistance to stress corrosion cracking in a supercritical water environment containing inorganic acids, aged test specimens of the Ni based alloy sheets D1 to D42 of the present invention, the comparative Ni based alloy sheets DC1 to DC11, and the conventional Ni based alloy sheets DU1 to DU3 were each held in the above supercritical water environment containing an inorganic acid for a period of 100 hours. The surface of each aged test specimen was then inspected for stress corrosion cracking. The results are shown in Table D1 through Table D4.

TABLE D1

| Ni based alloy sheet | | Composition (% by weight) (Remainder: Ni and unavoidable impurities) | | | | | | | | | | | Corrosion test results using simulated PCB or dioxin decomposition solution | |
|---|---|---|---|---|---|---|---|---|---|---|---|---|---|---|
| | | Cr | W | Mg | N | Mn | Nb | Mo | Hf | Fe | Si | C# | presence of stress corrosion cracking in solution test specimen | presence of stress corrosion cracking in aged test specimen |
| Present Invention | D1 | 28.3 | 0.32 | 0.015 | 0.007 | 0.23 | — | — | — | — | — | 0.02 | no | no |
| | D2 | 33.6 | 0.45 | 0.017 | 0.011 | 0.14 | — | — | — | — | — | 0.02 | no | no |
| | D3 | 31.6 | 0.11 | 0.015 | 0.020 | 0.28 | — | — | — | — | — | 0.01 | no | no |
| | D4 | 32.2 | 0.96 | 0.013 | 0.014 | 0.15 | — | — | — | — | — | 0.02 | no | no |
| | D5 | 30.4 | 0.48 | 0.001 | 0.013 | 0.18 | — | — | — | — | — | 0.02 | no | no |
| | D6 | 31.2 | 0.36 | 0.048 | 0.008 | 0.17 | — | — | — | — | — | 0.02 | no | no |
| | D7 | 30.7 | 0.55 | 0.017 | 0.001 | 0.18 | — | — | — | — | — | 0.02 | no | no |
| | D8 | 32.4 | 0.44 | 0.024 | 0.038 | 0.12 | — | — | — | — | — | 0.01 | no | no |
| | D9 | 33.2 | 0.36 | 0.026 | 0.025 | 0.05 | — | — | — | — | — | 0.02 | no | no |
| | D10 | 29.3 | 0.38 | 0.020 | 0.019 | 0.49 | — | — | — | — | — | 0.02 | no | no |
| | D11 | 30.2 | 0.44 | 0.012 | 0.011 | 0.18 | 1.3 | — | — | 0.15 | 0.021 | 0.02 | no | no |
| | D12 | 32.8 | 0.28 | 0.016 | 0.021 | 0.15 | 5.97 | — | — | — | — | 0.02 | no | no |
| | D13 | 31.1 | 0.36 | 0.030 | 0.024 | 0.12 | 2.5 | — | — | — | — | 0.02 | no | no |
| | D14 | 33.7 | 0.67 | 0.031 | 0.030 | 0.16 | 3.6 | — | — | — | — | 0.02 | no | no |

C# refers to the C quantity incorporated as an unavoidable impurity

TABLE D2

| Ni based alloy sheet | | Composition (% by weight) (Remainder: Ni and unavoidable impurities) | | | | | | | | | | | Corrosion test results using simulated PCB or dioxin decomposition solution | |
|---|---|---|---|---|---|---|---|---|---|---|---|---|---|---|
| | | Cr | W | Mg | N | Mn | Nb | Mo | Hf | Fe | Si | C# | presence of stress corrosion cracking in solution test specimen | presence of stress corrosion cracking in aged test specimen |
| Present Invention | D15 | 28.3 | 0.32 | 0.015 | 0.007 | 0.23 | 4.5 | — | — | — | — | 0.02 | no | no |
| | D16 | 31.1 | 0.36 | 0.030 | 0.024 | 0.12 | 2.1 | 0.02 | — | — | — | 0.02 | no | no |
| | D17 | 33.7 | 0.67 | 0.031 | 0.030 | 0.16 | — | 0.48 | — | — | — | 0.01 | no | no |
| | D18 | 32.2 | 0.96 | 0.013 | 0.014 | 0.15 | — | 0.15 | — | — | — | 0.02 | no | no |
| | D19 | 30.4 | 0.48 | 0.001 | 0.013 | 0.18 | — | 0.23 | — | — | — | 0.02 | no | no |
| | D20 | 31.2 | 0.36 | 0.048 | 0.008 | 0.17 | — | 0.34 | — | — | — | 0.02 | no | no |
| | D21 | 34.8 | 0.34 | 0.026 | 0.017 | 0.38 | 2.9 | — | 0.01 | — | — | 0.02 | no | no |
| | D22 | 34.8 | 0.17 | 0.028 | 0.021 | 0.18 | — | — | 0.09 | — | — | 0.03 | no | no |
| | D23 | 33.2 | 0.36 | 0.026 | 0.025 | 0.05 | — | — | 0.03 | — | — | 0.02 | no | no |
| | D24 | 29.3 | 0.38 | 0.020 | 0.019 | 0.49 | — | — | 0.05 | — | — | 0.02 | no | no |
| | D25 | 30.2 | 0.44 | 0.012 | 0.011 | 0.18 | — | — | 0.07 | — | — | 0.02 | no | no |
| | D26 | 32.5 | 0.27 | 0.030 | 0.006 | 0.26 | — | 0.21 | 0.02 | — | — | 0.02 | no | no |
| | D27 | 31.1 | 0.45 | 0.032 | 0.029 | 0.22 | — | — | — | 0.14 | — | 0.02 | no | no |
| | D28 | 30.1 | 0.49 | 0.021 | 0.013 | 0.11 | — | — | — | 9.88 | — | 0.02 | no | no |

C# refers to the C quantity incorporated as an unavoidable impurity

TABLE D3

| Ni based alloy sheet | | Composition (% by weight) (Remainder: Ni and unavoidable impurities) | | | | | | | | | | | Corrosion test results using simulated PCB or dioxin decomposition solution | |
|---|---|---|---|---|---|---|---|---|---|---|---|---|---|---|
| | | Cr | W | Mg | N | Mn | Nb | Mo | Hf | Fe | Si | C# | presence of stress corrosion cracking in solution test specimen | presence of stress corrosion cracking in aged test specimen |
| Present Invention | D29 | 28.3 | 0.32 | 0.015 | 0.007 | 0.23 | — | — | — | 2.85 | — | 0.02 | no | no |
| | D30 | 33.6 | 0.45 | 0.017 | 0.011 | 0.14 | — | — | — | 5.11 | — | 0.02 | no | no |
| | D31 | 31.6 | 0.11 | 0.015 | 0.020 | 0.28 | — | — | — | 6.38 | — | 0.01 | no | no |
| | D32 | 32.2 | 0.96 | 0.013 | 0.014 | 0.15 | — | — | — | — | 0.01 | 0.02 | no | no |
| | D33 | 30.4 | 0.48 | 0.001 | 0.013 | 0.18 | — | — | — | — | 0.09 | 0.02 | no | no |
| | D34 | 31.2 | 0.36 | 0.048 | 0.008 | 0.17 | — | — | — | — | 0.05 | 0.02 | no | no |
| | D35 | 29.6 | 0.45 | 0.031 | 0.031 | 0.16 | — | — | — | 0.26 | 0.02 | 0.02 | no | no |
| | D36 | 30.2 | 0.32 | 0.042 | 0.025 | 0.20 | 1.88 | 0.33 | 0.02 | — | 0.03 | 0.01 | no | no |
| | D37 | 31.3 | 0.47 | 0.030 | 0.038 | 0.14 | 2.03 | — | 0.04 | 1.22 | 0.02 | 0.02 | no | no |
| | D38 | 32.9 | 0.22 | 0.029 | 0.033 | 0.13 | 1.63 | — | — | 0.58 | — | 0.01 | no | no |
| | D39 | 30.6 | 0.18 | 0.028 | 0.026 | 0.11 | 1.22 | — | — | — | 0.08 | 0.02 | no | no |
| | D40 | 29.6 | 0.35 | 0.022 | 0.022 | 0.14 | 1.56 | — | 0.04 | — | — | 0.02 | no | no |
| | D41 | 31.1 | 0.36 | 0.030 | 0.024 | 0.12 | — | 0.031 | — | 3.2 | — | 0.02 | no | no |
| | D42 | 33.7 | 0.67 | 0.031 | 0.030 | 0.16 | — | — | 0.05 | — | 0.02 | 0.02 | no | no |

C# refers to the C quantity incorporated as an unavoidable impurity

TABLE D4

| Ni based alloy sheet | | Composition (% by weight) (Remainder: Ni and unavoidable impurities) | | | | | | | | | Corrosion test results using simulated PCB or dioxin decomposition solution | | |
|---|---|---|---|---|---|---|---|---|---|---|---|---|---|
| | | Cr | W | Mg | N | Mn | Mo | Fe | Si | C# | presence of stress corrosion cracking in solution test specimen | presence of stress corrosion cracking in aged test specimen | Remarks |
| Comparison | DC1 | 27.5* | 0.56 | 0.019 | 0.034 | 0.25 | — | — | — | 0.02 | yes | yes | — |
| | DC2 | 34.5* | 0.85 | 0.016 | 0.031 | 0.22 | — | — | — | 0.02 | no | no | overall corrosion |
| | DC3 | 32.4 | —* | 0.015 | 0.032 | 0.16 | — | — | — | 0.01 | yes | yes | — |
| | DC4 | 33.0 | 1.25* | 0.018 | 0.022 | 0.28 | — | — | — | 0.02 | no | yes | — |
| | DC5 | 31.2 | 0.13 | —* | 0.012 | 0.39 | — | — | — | 0.02 | no | yes | — |
| | DC6 | 32.4 | 0.62 | 0.055* | 0.015 | 0.21 | — | — | — | 0.02 | yes | yes | — |
| | DC7 | 32.7 | 0.55 | 0.017 | —* | 0.18 | — | — | — | 0.02 | no | yes | — |
| | DC8 | 29.8 | 0.67 | 0.025 | 0.046* | 0.38 | — | — | — | 0.01 | yes | yes | — |
| | DC9 | 31.1 | 0.45 | 0.016 | 0.019 | 0.04* | — | — | — | 0.01 | no | yes | — |
| | DC10 | 33.2 | 0.57 | 0.017 | 0.029 | 0.55* | — | — | — | 0.02 | yes | yes | — |
| | DC11 | 30.2 | 0.44 | 0.012 | 0.011 | 0.18 | — | — | — | 0.07* | no | yes | — |
| Conventional | DU1 | 21.0 | — | | Co: 0.6 | 0.2 | 8.4 | 3.8 | | — | yes | yes | — |
| | DU2 | 15.5 | 3.7 | | Co: 0.5 | 0.5 | 16.1 | 5.7 | | — | yes | yes | — |
| | DU3 | 28.7 | 2.6 | | Co: 1.87 | 1.1 | 5.0 | 14.6 | | Cu: 1.8 | no | yes | — |

*indicates a value outside the composition range of the present invention
C# refers to the C quantity incorporated as an unavoidable impurity From the results shown in Table D1 to Table D4 it is evident that both the solution test specimen and the aged test specimen for each of the Ni based alloy sheets D1 to D42 of the present invention displayed none of the stress corrosion cracking seen in the conventional Ni based alloy sheets DU1 and DU2, indicating a superior level of resistance to stress corrosion cracking. However, in the case of the comparative Ni based alloy sheets DC1 to DC11, which have compositions outside the ranges specified by the present invention, it is evident that either stress corrosion cracking developed in the solution test specimen and/or the aged test specimen, or there was a marked increase in overall corrosion.

INDUSTRIAL APPLICABILITY

As described above, a Ni based alloy of the aspect A of the present invention displays excellent corrosion resistance in supercritical water environments containing sulfuric acid, phosphoric acid and hydrofluoric acid, and can be used in such environments for extended periods, meaning the alloy has excellent industrial potential in areas such as the detoxification of chemical weapons and the like.

A Ni based alloy of this aspect A is most effective when used in supercritical water environments containing sulfuric acid, phosphoric acid and hydrofluoric acid, although potential uses of the alloy are not restricted to this type of environment, and the alloy can also be used in supercritical water environments containing hydrochloric acid or nitric acid, supercritical water environments containing chloride salts such as sodium chloride, magnesium chloride and calcium chloride, or supercritical water environments containing ammonia. Accordingly, the Ni based alloy can also be used as the material for supercritical water devices used for treating space related waste products, atomic waste products, power production waste products, as well as general industrial waste.

Furthermore, if a Ni based alloy of this aspect A is used in the production of the process reaction vessel in a treatment system, then the outside of the vessel could also be formed from a strong material such as stainless steel or the like, and the Ni based alloy then used to clad or line the interior surface of the stainless steel vessel.

Furthermore, a Ni based alloy of the aspect B of the present invention displays excellent corrosion resistance in supercritical water environments containing hydrochloric acid, and can be used in such environments for extended periods, meaning the alloy has excellent environmental and industrial potential in areas such as the detoxification of PCBs and dioxin and the like.

A Ni based alloy of this aspect B is most effective when used in supercritical water environments containing hydrochloric acid, although potential uses of the alloy are not restricted to this type of environment, and the alloy can also be used in supercritical water environments containing sulfuric acid, phosphoric acid, hydrofluoric acid or nitric acid, supercritical water environments containing chloride salts such as sodium chloride, magnesium chloride and calcium chloride, or supercritical water environments containing ammonia. Accordingly, the Ni based alloy can also be used as the material for supercritical water devices used for treating space related waste products, atomic waste products, power production waste products, as well as general industrial waste.

Furthermore, if a Ni based alloy of this aspect B is used in the production of the process reaction vessel in a treatment system, then the outside of the vessel could also be formed from a strong material such as stainless steel or the like, and the Ni based alloy then used to clad or line the interior surface of the stainless steel vessel.

In addition, a Ni based alloy of the aspect C of the present invention displays excellent resistance to stress corrosion cracking in supercritical water environments containing either sulfuric acid and phosphoric acid, or phosphoric acid and hydrofluoric acid, and can be used in such environments for extended periods, meaning the alloy has excellent environmental and industrial potential in areas such as the detoxification of VX gas and GB gas and the like.

A Ni based alloy of this aspect C is most effective when used in supercritical water environments containing non-chlorine based inorganic acids such as sulfuric acid, phosphoric acid and hydrofluoric acid, although potential uses of the alloy are not restricted to this type of environment, and the alloy can also be used in supercritical water environments containing hydrochloric acid or nitric acid, supercritical water environments containing chloride salts such as sodium chloride, magnesium chloride and calcium chloride, or supercritical water environments containing ammonia. Accordingly, the Ni based alloy can also be used as the material for supercritical water devices used for treating space related waste products, atomic waste products, power production waste products, as well as general industrial waste.

Furthermore, if a Ni based alloy of this aspect C is used in the production of the reaction chamber in a treatment system, then the outside of the chamber could also be formed from a strong material such as stainless steel or the like, and the Ni based alloy then used to clad or line the interior surface of the stainless steel chamber.

Furthermore, a Ni based alloy of the aspect D of the present invention displays excellent resistance to stress corrosion cracking in supercritical water environments containing hydrochloric acid, and can be used in such environments for extended periods, meaning the alloy has excellent environmental and industrial potential in areas such as the detoxification of PCBs and dioxin and the like.

A Ni based alloy of this aspect D is most effective when used in supercritical water environments containing hydrochloric acid, although potential uses of the alloy are not restricted to this type of environment, and the alloy can also be used in supercritical water environments containing sulfuric acid, phosphoric acid, hydrofluoric acid or nitric acid, supercritical water environments containing chloride salts such as sodium chloride, magnesium chloride and calcium chloride, or supercritical water environments containing ammonia. Accordingly, the Ni based alloy can also be used as the material for supercritical water devices used for treating space related waste products, atomic waste products, power production waste products, as well as general industrial waste.

Furthermore, if a Ni based alloy of this aspect D is used in the production of the reaction chamber in a treatment system, then the outside of the chamber could also be formed from a strong material such as stainless steel or the like, and the Ni based alloy then used to clad or line the interior surface of the stainless steel chamber.

The invention claimed is:

1. A Ni based alloy with excellent corrosion resistance relative to supercritical water environments containing inorganic acids consisting of in weight basis:

Cr: from more than 43% to 50% or less, Mo: 0.1% to 2%, Mg: 0.001% to 0.05%, N: 0.001% to 0.04%, Mn: 0.05% to 0.5%, at least one of Fe: 0.05% to 1.0% of and Si: 0.01% to 0.1%, and a remainder as Ni and unavoidable impurities, wherein a quantity of C amongst said unavoidable impurities is restricted to 0.05% or less, and the Ni based alloy consists essentially of a stabilized Ni-FCC matrix.

2. A member for a supercritical water process reaction apparatus, wherein said member comprises a Ni based alloy according to claim 1.

3. A system for detoxifying organic toxic materials comprising a member for a supercritical water process reaction apparatus, wherein said member comprises a Ni based alloy consisting of in weight basis:

Cr: from more than 43% to 50% or less, Mo: 0.1% to 2%, Mg: 0.001% to 0.05%, N: 0.001% to 0.04%, Mn: 0.05% to 0.5%, at least one of Fe: 0.05% to 1.0% of and Si: 0.01% to 0.1%, and a remainder as Ni and unavoidable impurities, wherein a quantity of C amongst said unavoidable impurities is restricted to 0.05% or less, and the Ni based alloy consists essentially of a stabilized Ni-FCC matrix.

* * * * *